US007872190B2

(12) United States Patent
Masuda

(10) Patent No.: US 7,872,190 B2
(45) Date of Patent: Jan. 18, 2011

(54) TONE SYNTHESIS APPARATUS AND METHOD

(75) Inventor: Hideyuki Masuda, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 202 days.

(21) Appl. No.: 12/351,299

(22) Filed: Jan. 9, 2009

(65) Prior Publication Data

US 2010/0175541 A1 Jul. 15, 2010

(30) Foreign Application Priority Data

Jan. 10, 2008 (JP) ..... 2008-003383
May 2, 2008 (JP) ..... 2008-120311

(51) Int. Cl.
*G10H 5/00* (2006.01)

(52) U.S. Cl. ..... 84/662

(58) Field of Classification Search ..... 84/744, 84/626, 662, 737, 723
See application file for complete search history.

(56) References Cited

U.S. PATENT DOCUMENTS 5,140,888 A * 8/1992 Ito ..... 84/723
5,149,904 A * 9/1992 Kamiya et al. ..... 84/723
5,170,003 A * 12/1992 Kawashima ..... 84/619
5,459,280 A * 10/1995 Masuda et al. ..... 84/622
5,521,328 A * 5/1996 Kakishita ..... 84/661
5,543,580 A * 8/1996 Masuda ..... 84/723
5,668,340 A * 9/1997 Hashizume et al. ..... 84/742
5,712,439 A * 1/1998 Toshifumi ..... 84/661
7,049,503 B2 * 5/2006 Onozawa et al. ..... 84/723
7,390,959 B2 * 6/2008 Masuda ..... 84/723
7,741,555 B2 * 6/2010 Onozawa ..... 84/653
2005/0217464 A1 * 10/2005 Onozawa et al. ..... 84/723
2007/0017346 A1 * 1/2007 Masuda ..... 84/600
2007/0068372 A1 * 3/2007 Masuda et al. ..... 84/723

OTHER PUBLICATIONS

Schumacher, R.T., "Ab Initio Calculations of the Oscillations of a Clarinet", Acustica, vol. 48, No. 2, 1981.
Sommerfeldt, S.D., et al., "Simulation of a Player-Clarinet System," Department of Physics and Astronomy, Brigham Young University, Provo, Utah, Oct. 7, 1986, pp. 1908-1918.

* cited by examiner

*Primary Examiner*—Jeffrey Donels
(74) *Attorney, Agent, or Firm*—Morrison & Foerster LLP

(57) ABSTRACT

Tone synthesis apparatus synthesizes a tone of a wind instrument generated in response to vibration of a reed contacting a lip during a performance of the wind instrument. First arithmetic operation section solves a motion equation representative of behavior of the reed in an equilibrium state with external force acting on the lip and a second motion equation representative of behavior of the lip in the equilibrium state, to thereby calculate displacement $y_b(x)$, $y_0(x)$ of the lip and reed in the equilibrium state. Second arithmetic operation section solves a motion equation of coupled vibration of the lip and reed with calculation results of the first arithmetic operation section used as initial values of the displacement $y_b(x)$, $y_0(x)$ of the lip and reed, to thereby calculate the displacement y(x, t) of the reed. Tone is synthesized on the basis of the displacement y(x, t) calculated by the second arithmetic operation section.

9 Claims, 13 Drawing Sheets

TONE SYNTHESIS APPARATUS AND METHOD

BACKGROUND

The present invention relates to a technique for synthesizing tones of wind instruments that generate tones in response to vibration of a reed.

Heretofore, there have been proposed tone synthesis apparatus of a physical model type (i.e., physical model tone generators) for synthesizing tones by simulating the tone generating principles of musical instruments. Among such tone synthesis apparatus are techniques disclosed in R. T. Schumacher "Ab Initio Calculations of the Oscillations of a Clarinet", ACUSTICA, 1981, Volume 48 No. 2, p. 75-p. 85 (hereinafter referred to as Non-patent Literature 1); and S. D. Sommerfeldt, W. J. Strong, "Simulation of a player-clarinet system", Acoustical Society of America, 1988, 83 (5), p. 1908-p. 1918 (hereinafter referred to as Non-patent Literature 2). More specifically, Non-patent Literature 1 discloses a technique for simulating behavior of a clarinet by modeling a reed as a rigid air valve freely movable in its entirety, and Non-patent Literature 2 discloses a technique for simulating behavior of a clarinet by modeling a reed using a vibrating member in the form of an elongate plate fixed at one end (i.e., cantilevered vibrating beam).

However, although the reed of an actual wind instrument behaves complicatedly in response to actions of a human player's lip, the techniques disclosed in Non-patent Literatures 1 and 2 only simulate simple external actions on the reed. Thus, with these techniques, behavior of the reed of an actual wind instrument can not be reproduced faithfully, so that it has been difficult to synthesize tones sufficiently approximate to tones of an actual wind instrument.

SUMMARY OF THE INVENTION

In view of the foregoing, it is an object of the present invention to synthesize a tone faithfully reflecting therein action of a human player's lip.

In order to accomplish the above-mentioned object, the present invention provides an improved apparatus for synthesizing a tone of a wind instrument that is generated in response to vibration of a reed contacting a lip during blowing or performance of the wind instrument, which comprises: a first arithmetic operation section that solves a first motion equation representative of behavior of the reed in an equilibrium state with external force acting on the lip and a second motion equation representative of behavior of the lip in the equilibrium state, to thereby calculate displacement of the lip and displacement of the reed in the equilibrium state; a second arithmetic operation section that solves a motion equation of coupled vibration of the lip and the reed with calculation results of the first arithmetic operation section used as initial values of the displacement of the lip and the displacement of the reed, to thereby calculate the displacement of the reed; and a tone synthesis section that synthesizes a tone on the basis of the displacement calculated by the second arithmetic operation section.

Because the displacement of the reed is calculated on the basis of the motion equation of coupled vibration, the present invention can accurately simulate behavior of the reed as compared to the conventional construction where behavior of the reed is calculated on the basis of a motion equation that does not reflect therein. As a result, the present invention can faithfully reproduce tones of an actual wind instrument.

In a preferred embodiment, each time intensity of the external force acting on the lip changes, the first arithmetic operation section calculates displacement of the lip corresponding to the changed intensity of the external force acting on the basis of the first motion equation and the second motion equation, and the second arithmetic operation section calculates displacement of the reed by substituting the displacement of the lip, calculated by the first arithmetic operation section, into the motion equation of coupled vibration. Because such an arrangement allows any change of the external force acting on the lip to be reflected in the displacement of the reed, the present invention can synthesize a variety of tones corresponding to a performance or rendition style that varies pressing force on the lip.

In a preferred embodiment, the first motion equation and the second motion equation include a spring constant of the lip that changes in accordance with a position in the lip and intensity of pressing force acting on the lip. Such an arrangement can faithfully simulate the characteristic of an actual lip that a spring constant of the lip changes in accordance with the intensity of the pressing force and the position in the lip. As a result, the present invention can accurately synthesize tones of a wind instrument.

In a preferred embodiment, the first motion equation includes bending rigidity that changes in accordance with a position of the reed. Such an arrangement can faithfully simulate the characteristic of an actual reed that bending rigidity of the reed (product between a second moment of area and a Young's modulus of the reed $M_R$) changes in accordance with the position of the reed. As a result, the present invention can accurately synthesize tones of a wind instrument as compared to the conventional construction where the reed is simulated with a mere elongated plate-shaped vibrating member that does not change in sectional shape.

In a preferred embodiment, the second arithmetic operation section limits the displacement of the reed to within a predetermined range. Because the displacement of the reed calculated on the basis of the motion equation of coupled vibration is limited to within the predetermined range, it is possible to prevent simulation of a situation where the reed is displaced to outside a displacement range of an actual reed, so that tones of an actual wind instrument can be reproduced accurately. The range within which the displacement of the reed is limited is preferably set to a range from the bottom surface of the lip and a surface of the mouthpiece opposed to the bottom surface.

In a preferred embodiment, the motion equation of coupled vibration includes at least one of internal resistance of the lip that changes in accordance with a position in the lip and internal resistance of the reed that changes in accordance with a position in the reed. Such an arrangement can simulate a situation where the internal resistance of the lip and internal resistance of the reed change in accordance with the positions, and thus, the present invention can faithfully reproduce tones of an actual wind instrument as compared to the conventional construction where the internal resistance of the lip and the internal resistance of the reed are set at fixed values.

In a case where deformation of the lip and reed is relatively small, i.e. where the deformation is within an elasticity limit), influences imparted from pressing force, acting on the lip and reed, to the internal resistance of the lip and reed can be ignored. However, in a case where deformation of the lip and reed is great, i.e. where the deformation is outside the elasticity limit), the internal resistance of the lip and reed would also change in accordance with the intensity of the pressing force as well as positions in the lip and reed. Thus, in a preferred embodiment of the present invention, the motion equation of coupled vibration includes at least one of internal resistance of the lip that changes in accordance with a position in the lip and pressing force acting on the lip and internal resistance of the reed that changes in accordance with a position in the reed and pressing force acting on the reed. Such an arrangement can simulate a situation where the internal resistance of the lip and the internal resistance of the reed change in accordance with the intensity of the pressing force, and thus, the present invention can faithfully reproduce tones of an actual wind instrument as compared to the conventional construction where the internal resistance of the lip and the internal resistance of the reed are set at fixed values.

The tone synthesis apparatus of the present invention can be implemented not only by hardware electronic circuitry, such as DSPs (Digital Signal Processors) dedicated to individual processes, but also by a cooperation between a general-purpose arithmetic operation processing apparatus and a program. The program of the present invention is a program for synthesizing a tone of a wind instrument that is generated in response to vibration of a reed contacting a lip during blowing or performance of the wind instrument, which causes a computer to perform: a first arithmetic operation step of solving a first motion equation representative of behavior of the reed in an equilibrium state with external force acting on the lip and a motion equation representative of behavior of the lip in the equilibrium state, to thereby calculate displacement of the lip and displacement of the reed in the equilibrium state; a second arithmetic operation step of solving a motion equation of coupled vibration of the lip and the reed with calculation results of the first arithmetic operation step used as initial values of the displacement of the lip and the displacement of the reed, to thereby calculate the displacement of the reed; and a tone synthesis step of synthesizing a tone on the basis of the displacement calculated by the second arithmetic operation step. Such a program can achieve the same advantageous benefits as the tone synthesis apparatus of the present invention. Typically, the program of the present invention is provided to a user in a computer-readable storage medium and then installed into a computer, or delivered to a user via a communication network and then installed into a computer.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

First Embodiment

Figure 1:
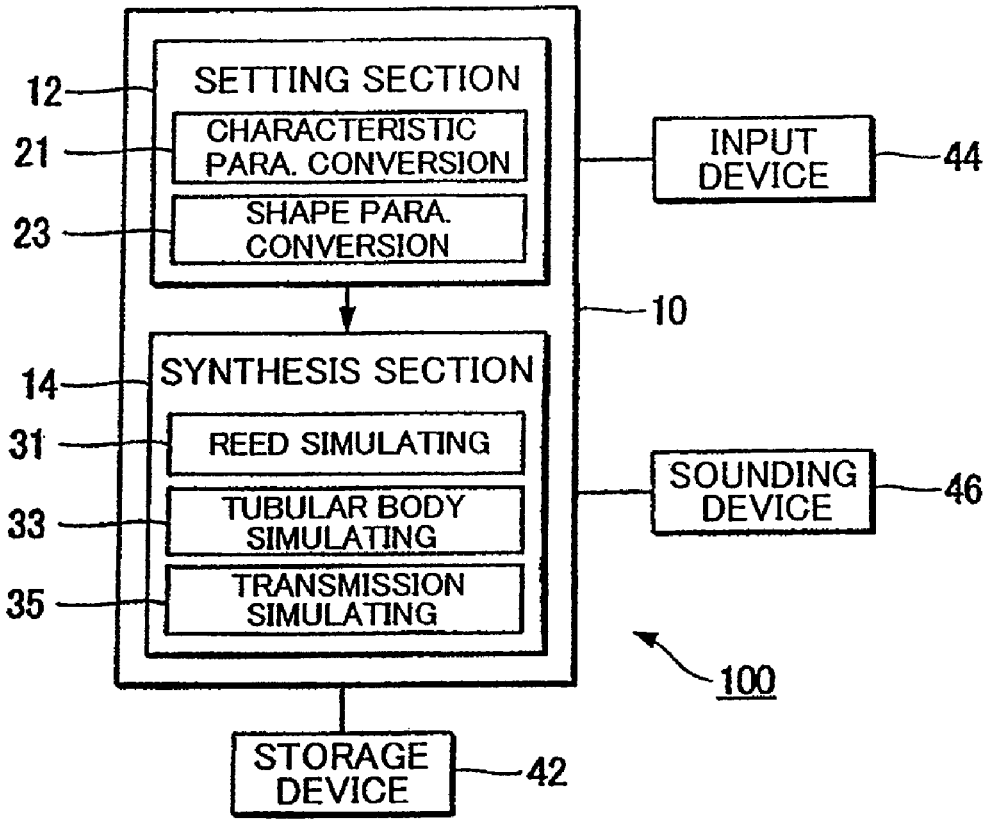
FIG. 1 is a block diagram showing an example setup of a first embodiment of a tone synthesis apparatus of the present invention.

FIG. 1 is a block diagram showing an example setup of a first embodiment of a tone synthesis apparatus of the present invention. This tone synthesis apparatus 100 is constructed to synthesize tones by simulating, through arithmetic operations, the tone generating principles of a single-reed wind instrument, such as a saxophone or clarinet. As shown in FIG. 1, the tone synthesis apparatus 100 is implemented by a computer system that comprises an arithmetic operation processing device 10, a storage device 42 and a sounding device 46.

The arithmetic operation processing device, such as a CPU (Central Processing Unit) 10, executes programs, stored in the storage device 42, to generate and output tone data representative of a time-varying waveform of a wind instrument (i.e., temporal variation of sound pressure). The storage device 42 stores therein programs for execution by the arithmetic operation processing device 10 and data for use by the arithmetic operation processing device 10. Magnetic storage device, semiconductor storage device or other conventionally-known storage device may be employed as the storage device 42.

The input device 44 includes a plurality of operating members operable by a user or human player. Via the input device 44, the human player can input, to the arithmetic operation processing device 10, various parameters to be used for tone synthesis. Input equipment, such as a keyboard and mouse, and musical-instrument type input equipment, such as MIDI (Musical Instrument Digital Interface) controller, for inputting information pertaining to a performance of a wind instrument is employable as the input device 44.

The sounding device 46 radiates a sound wave corresponding to tone data output by the arithmetic operation processing device 10. Although not particularly shown in FIG. 1, the tone synthesis apparatus in practice further includes a D/A converter for converting tone data into an analog tone signal, and an amplifier for amplifying and outputting such a tone signal.

The arithmetic operation processing device 10 functions also as a setting section 12 and a synthesis section 14. In a modification, various functions of the arithmetic operation processing device 10 may be implemented distributively by a plurality of integrated circuits. Further, part of the functions of the processing device 10 may be implemented by dedicated circuitry (DSP) for tone synthesis.

The setting section 12 sets parameters necessary for tone synthesis. The synthesis section 14 generates tone data on the basis of the parameters set by the setting section 12, and it includes a reed simulating section 31, a tubular body simulating section 33 and a transmission simulating section 35. The reed simulating section 31 simulates coupled vibration of the player's lip and the reed. The tubular body simulating section 33 simulates behavior of a tubular portion of the wind instrument from the mouthpiece to the bell (namely, tubular body portion other than the reed). The transmission simulating section 35 simulates impartment of transmission characteristics to radiated sounds from the bell and individual tone holes.

Figure 2:
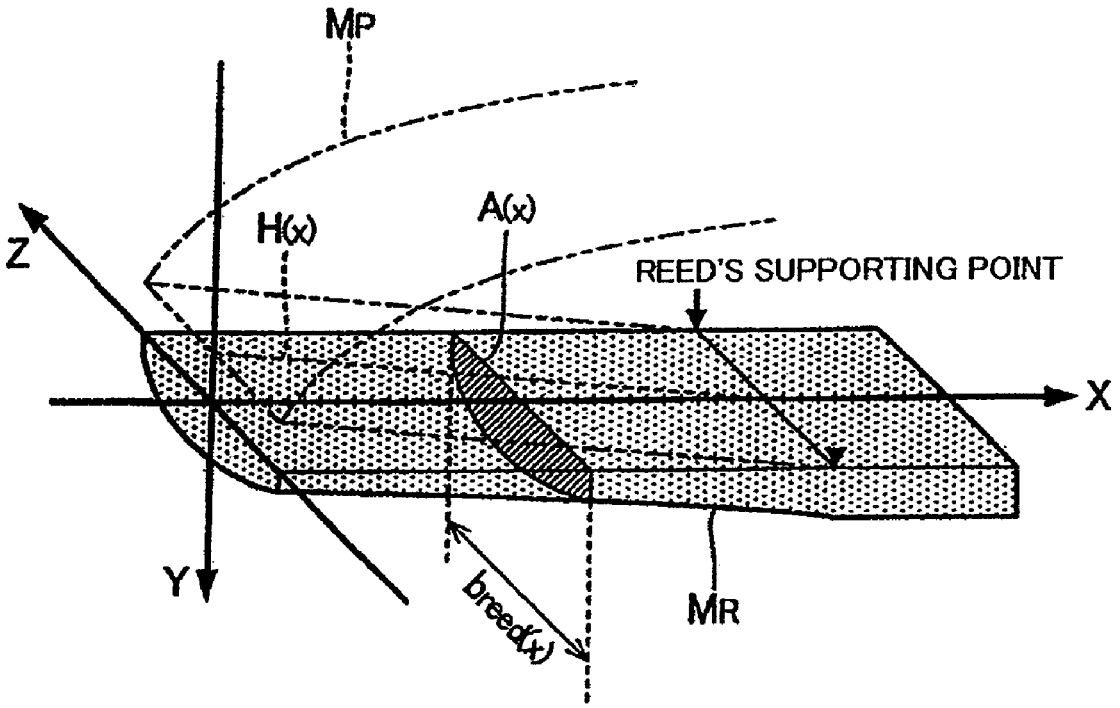
FIG. 2 is a conceptual diagram showing a reed and a neighborhood of the reed in a wind instrument which are to be simulated by a reed simulating section in the first embodiment.

FIG. 2 is a conceptual diagram showing the reed and neighborhood thereof of the wind instrument which are to be simulated by the reed simulating section 31. The reed $M_R$ is a vibrating member of an elongated plate shape having one end fixed to the mouthpiece $M_P$. Let it be assumed here that X, Y and Z axes intersect with one another at an original point coinciding with a middle point, in a width direction, of a distal end of the reed $M_R$. The Z axis extends in a width direction of the reed $M_R$. The X axis intersects with the Z axis in the upper surface (i.e., surface opposed to the mouthpiece $M_P$) of the reed $M_R$ when no external force is acting on the reed $M_R$. Further, the Y axis extends in a vertical (thickness) direction of the reed $M_R$ to intersect with the X and Z axes.

Figure 3:
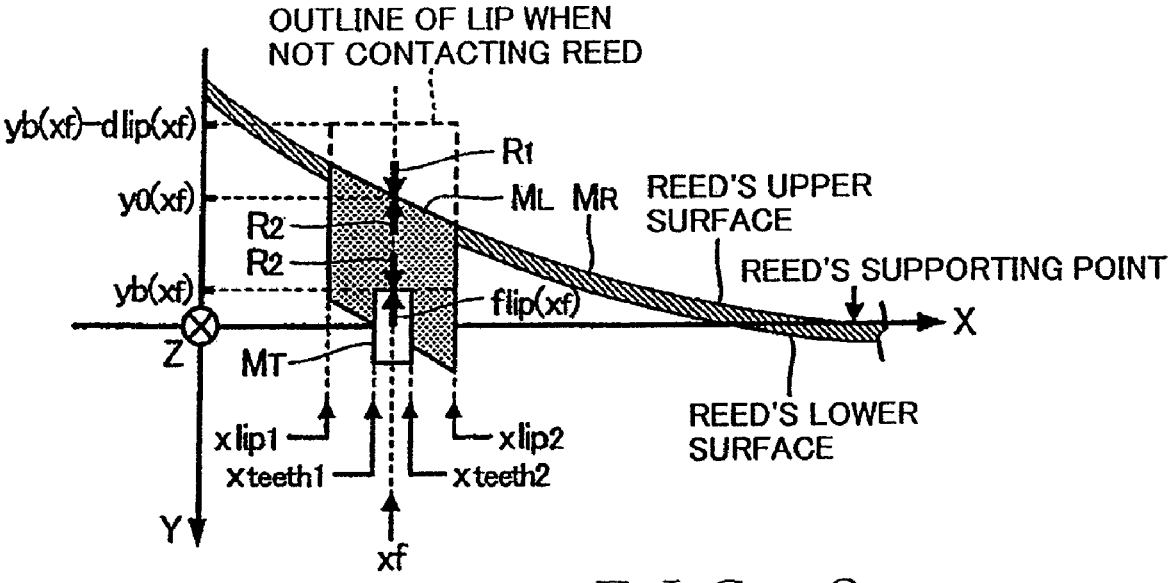
FIG. 3 is a schematic view showing contact between a lip and the reed during a performance of the wind instrument.

FIG. 3 is a schematic exaggerated view of the reed $M_R$ and neighborhood thereof, which are to be simulated by the reed simulating section 31, taken in the Z direction, which is explanatory of how a human player's lip $M_L$ contacts the reed $M_R$ at the time of a performance of the wind instrument. As shown in FIG. 3, the reed simulating section 31 simulates a state where the human player presses the lip $M_L$ against the reed $M_R$ with teeth $M_T$ during the performance of the wind instrument. The lip $M_L$ contacts a portion of the reed $M_R$ from a position $x_{lip1}$ (adjacent to the distal end of the reed $M_R$) to a position $x_{lip2}$ (adjacent to the base of the reed $M_R$) in the X direction. Further, the teeth $M_T$ of the human player contact a portion of the lip $M_L$ from a position $x_{teeth1}$ (adjacent to the distal end of the reed $M_R$) to a position $x_{teeth2}$ (adjacent to the base of the reed $M_R$) in the X direction, to thereby cause pressing force $f_{lip}(x)$ to act uniformly on the reed $M_R$.

Figure 4:
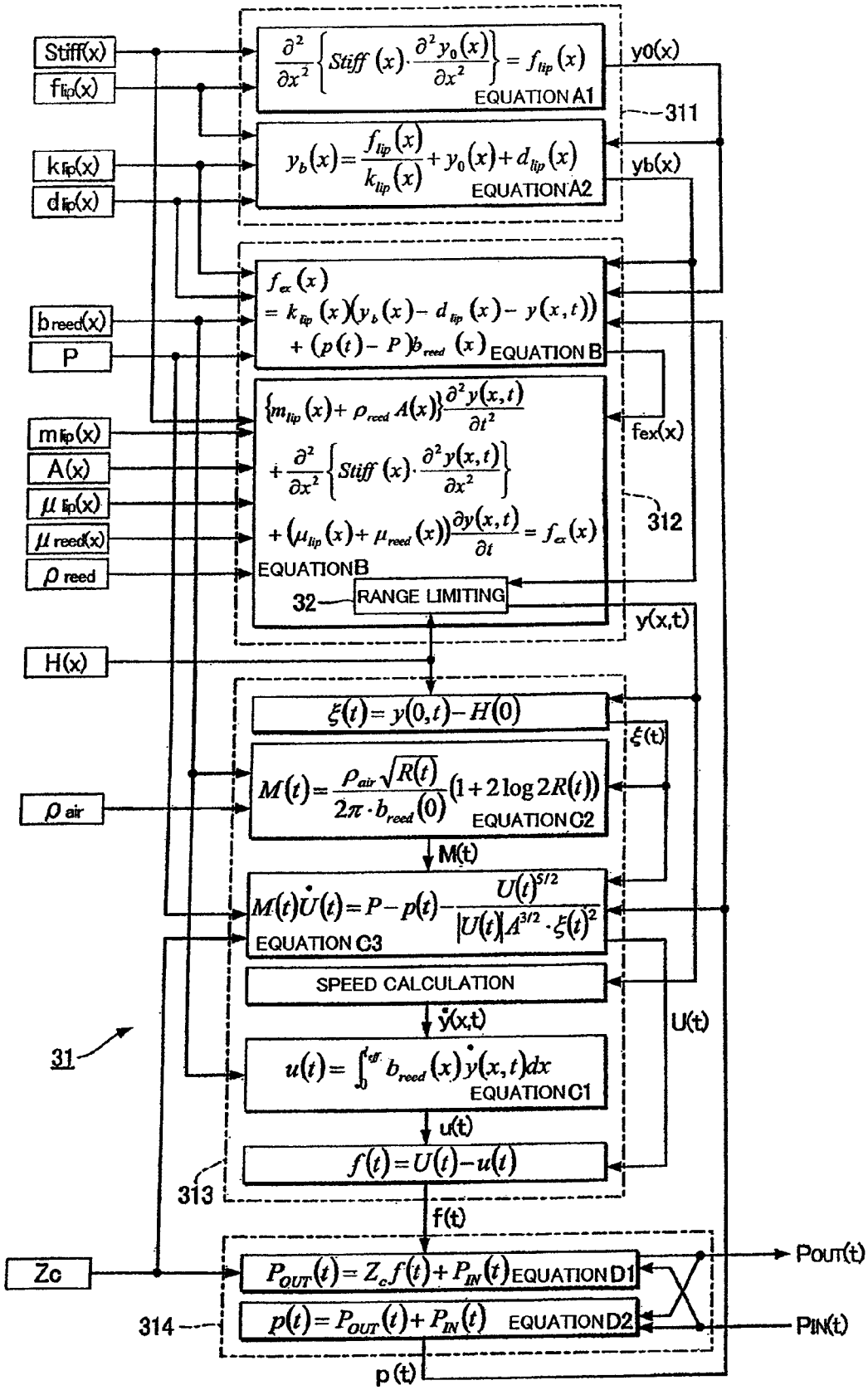
FIG. 4 is a block diagram showing functions of the reed simulating section.

FIG. 4 is a block diagram showing functions of the reed simulating section 31. In a left area of FIG. 4 are shown parameters set by the setting section 12 and then stored in the storage device 42. The following lines describe meanings of the parameters.

First, parameters $S_{tiff}(x)$, $B_{reed}(x)$, $A(x)$, $\mu_{reed}(x)$ and $\rho_{reed}(x)$ pertaining to the reed $M_R$ will be described. $S_{tiff}(x)$ represents bending rigidity ($N \cdot m^2$) of the reed $M_R$ at a position x in the X direction. Namely, the bending rigidity $S_{tiff}(x)$ corresponds to a product between a Young's modulus of the reed $M_R$ and a second moment of area $I(x)$ [$m^4$] of the reed $M_R$ at the position x. As shown in FIG. 2, $B_{reed}(x)$ represents a horizontal width [m] (i.e., dimension in the Z direction) at the position x, and $A(x)$ is a sectional area (i.e., area in a Y-Z plane passing the position x) [$m^2$] of the reed $M_R$ at the position x. In the illustrated example, the sectional shape of the reed $M_R$ varies depending on where the position x in the X direction is. Thus, the second moment of area $I(x)$, horizontal width $B_{reed}(x)$ and sectional area $A(x)$ of the reed $M_R$ to be used in calculation of the bending rigidity $S_{tiff}(x)$ are functions of the position x. Further, $\mu_{reed}(x)$ represents a distribution of internal resistance [(kg/sec)/m] of the reed $M_R$, and $\rho_{reed}(x)$ represents a density [$kg/m^3$] of the reed $M_R$.

Next, parameters $k_{lip}(x)$, $d_{lip}(x)$, $A(x)$, $\mu_{lip}(x)$ and $m_{lip}(x)$ pertaining to the lip $M_L$ will be described. $k_{lip}(x)$ represents a distribution of spring constant [$N/m^2$], in the X direction, of the lip $M_L$ (e.g., spring constant for a unit length, in the X direction, of the lip $M_L$). $d_{lip}(x)$ represents a dimension in the Y direction (i.e., thickness) [m] of the lip $M_L$ at the position x when no external force acts on the lip $M_L$. $\mu_{lip}(x)$ represents a distribution of internal resistance [kg/sec)/m] of the lip $M_L$ at the position x. $m_{lip}(x)$ represents a distribution of mass [kg/m], in the X direction, of the lip $M_L$. The distribution of spring constant $k_{lip}(x)$, thickness $d_{lip}(x)$, distribution of internal resistance $\mu_{lip}(x)$ and distribution of mass $m_{lip}(x)$ vary depending on where the position x in the X direction is.

Further, in FIG. 4, P represents pressure (Pa) within the mouth cavity of the human player, and ρ air represents a density of air ($kg/m^3$) at normal temperature (e.g., 25° C.). H(x) represents a position, in the Y direction, on the surface of the mouthpiece $M_P$ opposed to the reed $M_R$, as seen in FIG. 2; such a position H(x) will hereinafter be referred to as "facing position". Once displacement y(x,t), in the Y direction, of the reed $M_R$ reaches the facing position H(x), the upper surface of the reed $M_R$ contacts the mouthpiece $M_P$; thus, the facing position H(x) corresponds to a limit value (i.e., lower limit value) of the displacement of the reed $M_R$. Further, $Z_c$ represents characteristic impedance to an air flow at a starting point of a portion of the mouthpiece $M_P$ that can be regarded as a tubular body (i.e., the base of the reed $M_R$).

As shown in FIG. 4, the reed simulating section 31 comprises first, second, third and fourth arithmetic operation sections 311, 312, 313 and 314. The first arithmetic operation section 311 calculates displacement $y_0(xf)$ of the reed $M_R$ and displacement $y_b(xf)$ of the bottom surface of the lip $M_L$ when the lip $M_L$ is in an equilibrium state with pressing force $f_{lip}(xf)$ caused to statically act on a position xf, in the Y direction, of the lip $M_L$. The second arithmetic operation section 312 calculates displacement y(x,t) in the Y direction at a time t at each position x, in the X direction, of the reed $M_R$ by solving a motion equation of coupled vibration between the lip $M_L$ and the reed $M_R$ using the displacement $y_0(xf)$ and displacement $y_b(xf)$, calculated by the first arithmetic operation section 311, as initial displacement values (i.e., values when t=0) of the reed $M_R$ and lip $M_L$. The third and fourth arithmetic operation sections 313 and 314 calculate pressure $P_{OUT}$ of a sound wave to be output from the reed $M_R$ to the tubular body portion (adjacent to the mouthpiece $M_P$) on the basis of the displacement y(x,t) of the reed $M_R$. Details of processing performed by the reed simulating section 31 will be discussed below.

Let's now consider an equilibrium state achieved by causing pressing force $f_{lip}(xf)$ to act from the teeth $M_T$ on a position $x_f$ ($x_{teeth1} \leqq x_f \leqq x_{teeth2}$) of the human player's lip $M_L$, as shown in FIG. 3. Assuming that the reed $M_R$ has been deformed in the Y direction is deformed in the Y direction by a distance d1 and the lip $M_L$ by a distance d2 due to pressing force $f_{lip}(xf)$, resilient force R1 acting from the reed $M_R$ on the lip $M_L$ and resilient force R2 acting from the lip $M_L$ on the reed $M_R$ can be expressed by the following mathematical expressions. Note that, although in reality the upper surface of the lip $M_L$ contacts the lower surface of the reed $M_R$, FIG. 3 shows in a schematically simplified manner the upper surface of the lip $M_L$ as positioned on the upper surface of the reed $M_R$.

$$R_1 = \frac{\partial^2}{\partial x^2}\left\{\mathrm{Stiff}(x_f)\cdot\frac{\partial^2 d_1}{\partial x^2}\right\}$$

$$R_2 = k_{lip}(x_f)\cdot d_2$$

From force balance at the contact point (position $x_f$) between the reed $M_R$ and the lip $M_L$, R1−R2=0 is established, and From force balance at the contact point (position $x_f$) between the lip $M_L$ and the teeth $M_T$, $F_{lip}(xf)=0$ is established.

Further, from relationship between deformation and displacement of the reed $M_R$, d1=$y_0$(xf) is established, and Further, from relationship between deformation and displacement of the lip $M_L$, d2={$y_b$(xf)−$d_{lip}$(xf)−$y_0$(xf)} is established.

From the individual mathematical expressions above, Motion Equations A1 and A2 can be derived.

$$\frac{\partial^2}{\partial x^2}\left\{\mathrm{Stiff}(x_f)\cdot\frac{\partial^2 y_0(x_f)}{\partial x^2}\right\} = f_{lip}(x_f) \quad \text{A1}$$

$$y_b(x_f) = \frac{f_{lip}(x_f)}{k_{lip}(x_f)} + y_0(x_f) + d_{lip}(x_f) \quad \text{A2}$$

The first arithmetic operation section 311 shown in FIG. 4 calculates displacement $y_b$(xf) of the bottom surface of the lip $M_L$ and displacement y0(xf) of the reed $M_R$ by solving Motion Equations A1 and A2 by substituting thereinto the bending rigidity $S_{tiff}$(xf), pressing force $f_{lip}$(xf), spring constant $k_{lip}$(xf) and thickness $d_{lip}$(xf). More specifically, the first arithmetic operation section 311 calculates displacement y0(xf) of the reed $M_R$ from Motion Equation A1 using difference equation conversion, Gaussian elimination method or the like and then calculates displacement $y_b$(xf) of the lip $M_L$ by substituting the calculated displacement y0(xf) into Motion Equation A2. How to solve Motion Equation A1 will be described later.

Dynamic characteristics when the lip $M_L$ and reed $M_R$ vibrate in a coupled manner can be expressed by Motion Equation B below.

$$\{m_{lip}(x) + \rho_{reed}A(x)\}\frac{\partial^2 y(x,t)}{\partial t^2} + \frac{\partial^2}{\partial x^2}\left\{\mathrm{Stiff}(x)\cdot\frac{\partial^2 y(x,t)}{\partial x^2}\right\} + (\mu_{lip}(x) + \mu_{reed}(x))\frac{\partial y(x,t)}{\partial t} = k_{lip}(x)\{y_b(x) - d_{lip}(x) - y(x,t)\} + \{p(t) - P\}\cdot b_{reed}(x) \quad \text{B}$$

The second arithmetic operation section 312 calculates displacement y(x, t) of the reed $M_R$ by setting the displacement y0(xf), calculated by the first arithmetic operation section 311, as an initial value of the displacement y(xt) of the reed $M_R$ and substituting the displacement $y_b$(xf), calculated by the first arithmetic operation section 311, into the displacement $y_b$(x) of the lip $M_L$ in Motion Equation B. The right side of Equation B represents external force $f_{ex}$(x) acting on the position x, in the X direction, of the reed $M_R$. First, the second arithmetic operation section 312 calculates external force $f_{ex}$(x) by not only substituting into the right side of Motion Equation B the parameters $b_{reed}$(x), P, $k_{lip}$(x) and $d_{lip}$(x) set by the setting section 12 and pressure p(t) calculated by the fourth arithmetic operation section 314 but also substituting the displacement y0(xf) and displacement $y_b$(xf), calculated by the first arithmetic operation section 311, into the right side of Motion Equation B as initial values of the displacement y(x, t) and displacement $y_b$(x). The pressure p(t) is pressure in a portion of a gap between the reed $M_R$ and the mouthpiece $M_P$ close to the distal end of the reed $M_R$ (hereinafter referred to as "immediately-above-reed portion"). Calculation, by the fourth arithmetic operation section 314, of the pressure p(t) will be described later.

Second, the second arithmetic operation section 312 calculates displacement y(x, t) of the reed $M_R$ by substituting the parameters $m_{lip}$(x), A(x), $\mu_{reed}$(x), $S_{tiff}$(x) and ρ reed, set by the setting section 12, into the left side of Motion Equation B and setting the external force $f_{ex}$(x) calculated earlier into the right side of Motion Equation B. How to solve Motion Equation B will be described later.

The second term in the left side of Motion Equation B can be transformed as follows:

$$\begin{aligned}
\frac{\partial^2}{\partial x^2}\left\{\mathrm{Stiff}(x)\cdot\frac{\partial^2 y}{\partial x^2}\right\} &= E_{reed}\frac{\partial}{\partial x}\left\{\frac{\partial}{\partial x}\left(I(x)\cdot\frac{\partial^2 y}{\partial x^2}\right)\right\} \\
&= E_{reed}\frac{\partial}{\partial x}\left\{\left(\frac{\partial}{\partial x}I(x)\right)\cdot\frac{\partial^2 y}{\partial x^2} + I(x)\frac{\partial^3 y}{\partial x^3}\right\} \\
&= E_{reed}\left[\begin{array}{c}\frac{\partial}{\partial x}\left\{\left(\frac{\partial}{\partial x}I(x)\right)\cdot\frac{\partial^2 y}{\partial x^2}\right\} + \\ \frac{\partial}{\partial x}\left\{I(x)\frac{\partial^3 y}{\partial x^3}\right\}\end{array}\right] \\
&= E_{reed}\left[\begin{array}{c}\left\{\left(\frac{\partial^2}{\partial x^2}I(x)\right)\cdot\frac{\partial^2 y}{\partial x^2}\right\} + \\ \left\{\left(\frac{\partial}{\partial x}I(x)\right)\cdot\frac{\partial^3 y}{\partial x^3}\right\} + \\ \left\{\left(\frac{\partial}{\partial x}I(x)\right)\cdot\frac{\partial^3 y}{\partial x^3}\right\} + \\ I(x)\cdot\frac{\partial^4 y}{\partial x^4}\end{array}\right] \\
&= E_{reed}\left[\begin{array}{c}\left\{\left(\frac{\partial^2}{\partial x^2}I(x)\right)\cdot\frac{\partial^2 y}{\partial x^2}\right\} + \\ \left\{\left(2\frac{\partial}{\partial x}I(x)\right)\cdot\frac{\partial^3 y}{\partial x^3}\right\} + \\ I(x)\cdot\frac{\partial^4 y}{\partial x^4}\end{array}\right]
\end{aligned}$$

Therefore, Motion Equation B can be transformed into Equation B1 below.

$$\{m_{lip}(x) + \rho_{reed}A(x)\}\frac{\partial^2 y(x,t)}{\partial t^2} + E_{reed}\left[\begin{array}{c}\left\{\left(\frac{\partial^2}{\partial x^2}I(x)\right)\cdot\frac{\partial^2 y}{\partial x^2}\right\} + \\ \left\{\left(2\frac{\partial}{\partial x}I(x)\right)\cdot\frac{\partial^3 y}{\partial x^3}\right\} + I(x)\cdot\frac{\partial^4 y}{\partial x^4}\end{array}\right] + (\mu_{lip}(x) + \mu_{reed}(x))\frac{\partial y(x,t)}{\partial t} = k_{lip}(x)\{y_b(x) - d_{lip}(x) - y(x,t)\} + \{p(t) - P\}\cdot b_{reed}(x) \quad \text{B1}$$

Next, the time t is discretized as a product between an integer i and a predetermined value Δt (i.e., t=i·Δt), and then the time derivatives are substituted by the following differences.

$$\frac{\partial y}{\partial t} \leftrightarrow \frac{y(n, i+1) - y(n, i-1)}{2(\Delta t)},$$

$$\frac{\partial^2 y}{\partial t^2} \leftrightarrow \frac{y(n, i+1) - 2y(n, i) + y(n, i-1)}{(\Delta t)^2}$$

Figure 5:
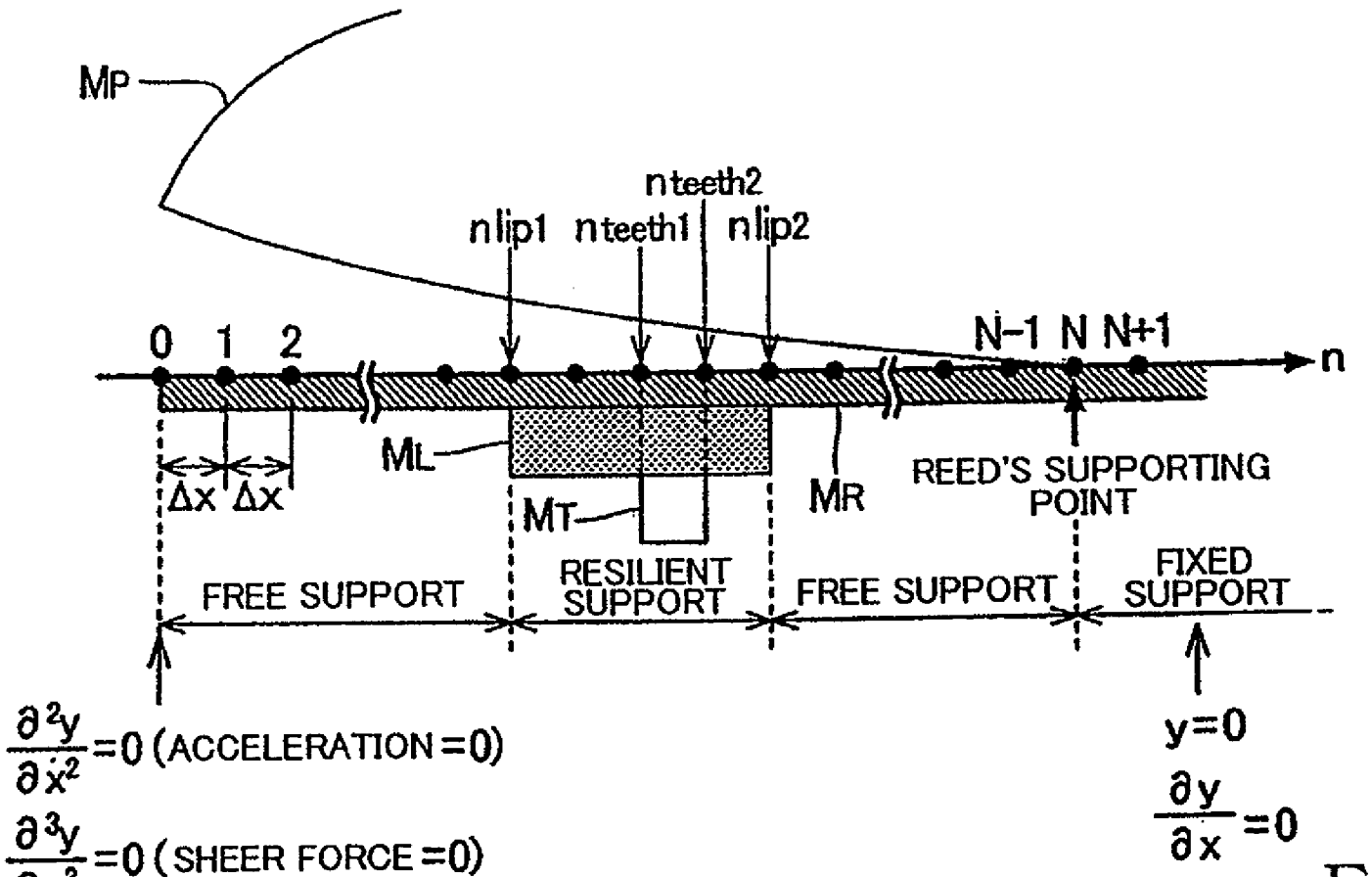
FIG. 5 is a conceptual diagram explanatory of discretization in position in an X direction performed in the first embodiment.

Further, as shown in FIG. 5, the position x in the X direction is discretized in such a manner that the discretized positions are distributed at equal intervals Δx. Namely, the position x is discretized as a product between an integer n and a predetermined value Δx (i.e., x=n·Δx), and then the position derivatives are substituted by the following differences.

$$\frac{\partial^2 y}{\partial x^2} \leftrightarrow \frac{y(n+1,\ i) - 2y(n,\ i) + y(n-1,\ i)}{(\Delta x)^2}$$

$$\frac{\partial^3 y}{\partial x^3} \leftrightarrow \frac{y(n+2,\ i) - 3y(n+1,\ i) + 3y(n,\ i) - y(n-1,\ i)}{(\Delta x)^3}$$

$$\frac{\partial^4 y}{\partial x^4} \leftrightarrow \frac{\begin{matrix} y(n+2,\ i) - 4y(n+1,\ i) + \\ 6y(n,\ i) - 4y(n-1,\ i) + y(n-2,\ i) \end{matrix}}{(\Delta x)^4}$$

Note that "y(n, i)" above is an abbreviation of y(n·Δx, i·Δt). Thus, Mathematical Expression B1 above can be rewritten as Equation B2 below.

$$\begin{aligned} &\{m_{lip}(n) + \rho_{reed}A(n)\}\frac{y(n,\ i+1) - 2y(n,\ i) + y(n,\ i-1)}{(\Delta t)^2} + \\ &E_{reed}\left\{I'' \cdot \frac{y(n+1,\ i) - 2y(n,\ i) + y(n-1,\ i)}{(\Delta x)^2}\right\} + \\ &E_{reed}\left\{2I' \cdot \frac{y(n+2,\ i) - 3y(n+1,\ i) + 3y(n,\ i) - y(n-1,\ i)}{(\Delta x)^3}\right\} + \\ &E_{reed}\left\{I \cdot \frac{\begin{matrix} y(n+2,\ i) - 4y(n+1,\ i) + \\ 6y(n,\ i) - 4y(n-1,\ i) + y(n-2,\ i) \end{matrix}}{(\Delta x)^4}\right\} + \\ &\{\mu_{lip}(n) + \mu_{reed}(n)\} \cdot \frac{y(n,\ i+1) - y(n,\ i-1)}{2(\Delta t)} + k_{lip}(n) \cdot y(n,\ i) = \\ &k_{lip}(n)(y_b(n) - d_{lip}(n)) + (p(i) - P)b_{reed}(n) \end{aligned} \quad \text{B2}$$

Note, however, that, in Equation B2 above, the individual terms are results of the following substitutions:

$$I = I(x) = I(n \cdot \Delta x)$$

$$I' = \frac{\partial}{\partial x} I(x) = \frac{I((n+1)\cdot\Delta x) - I((n-1)\cdot\Delta x)}{2(\Delta x)}$$

$$I'' = \frac{\partial^2}{\partial x^2} I(x) = \frac{I((n+1)\cdot\Delta x) - 2I(n\cdot\Delta x) + I((n-1)\cdot\Delta x)}{(\Delta x)^2}$$

Note that "(n, i)" added to some letters in Equation B2 above is an abbreviation of y(n·Δx, i·Δt).

Next, Equation B3 approximately expressing Equation B2 above is derived by adding together (1) an equation obtained by multiplying the second term through to the fourth term in the left side of Equation B2 by ½ and (2) an equation obtained by substituting "i" in Equation B2 by (i+1) and then multiplying the second term through to the fourth term in the left side of Equation B2 by ½.

$$\begin{aligned} &\{m_{lip}(n) + \rho_{reed}A(n)\}\frac{y(n,\ i+1) - 2y(n,\ i) + y(n,\ i-1)}{(\Delta t)^2} + \\ &E_{reed}I''\left\{\begin{matrix} \dfrac{y(n+1,\ i) - 2y(n,\ i) + y(n-1,\ i)}{2(\Delta x)^2} + \\ \dfrac{y(n+1,\ i+1) - 2y(n,\ i+1) + y(n-1,\ i+1)}{2(\Delta x)^2} \end{matrix}\right\} + \end{aligned} \quad \text{B3}$$

-continued $$2E_{reed}I'\left\{\begin{matrix} \dfrac{\begin{matrix} y(n+2,\ i) - 3y(n+1,\ i) + \\ 3y(n,\ i) - y(n-1,\ i) \end{matrix}}{2(\Delta x)^3} + \\ \dfrac{\begin{matrix} y(n+2,\ i+1) - 3y(n+1,\ i+1) + \\ 3y(n,\ i+1) - y(n-1,\ i+1) \end{matrix}}{2(\Delta x)^3} \end{matrix}\right\} +$$

$$E_{reed}I\left\{\begin{matrix} \dfrac{\begin{matrix} y(n+2,\ i) - 4y(n+1,\ i) + \\ 6y(n,\ i) - 4y(n-1,\ i) + y(n-2,\ i) \end{matrix}}{2(\Delta x)^4} + \\ \dfrac{\begin{matrix} y(n+2,\ i+1) - 4y(n+1,\ i+1) + \\ 6y(n,\ i+1) - 4y(n-1,\ i+1) + y(n-2,\ i+1) \end{matrix}}{2(\Delta x)^4} \end{matrix}\right\} +$$

$$\begin{aligned} &\{\mu_{lip}(n) + \mu_{reed}(n)\}\left\{\frac{y(n,\ i+1) - y(n,\ i-1)}{2(\Delta t)}\right\} + k_{lip}(n) \cdot y(n,\ i) = \\ &k_{lip}(n)(y_b(n) - d_{lip}(n)) + (p(i) - P)b_{reed}(n) \end{aligned}$$

If the individual terms in Equation B3 are rearranged per type of the variable y, Equation B4 can be derived as follows:

$$\begin{aligned} &a(1)_n y(n-2,\ i+1) + a(2)_n y(n-1,\ i+1) + \\ &a(3)_n y(n,\ i+1) + a(4)_n y(n+1,\ i+1) + a(5)_n y(n+2,\ i+1) = \\ &b(1)_n y(n-2,\ i) + b(2)_n y(n-1,\ i) + b(3)_n y(n,\ i) + \\ &b(4)_n y(n+1,\ i) + b(5)_n y(n+2,\ i) + c(1)_n y(n,\ i-1) + \\ &k_{lip}(n) \cdot (y_b(n) - d_{lip}(n)) + (p(i) - P)b_{reed}(n) \end{aligned} \quad \text{B4}$$

Note that the individual terms in Equation B4 are terms previously substituted as follows:

$$a(1)_n = -b(1) = E_{reed}I/\Delta x^4/2$$

$$a(2)_n = -b(2) = E_{reed}I''/\Delta x^2/2 - 2E_{reed}I'/\Delta x^3/2 - 4E_{reed}I/\Delta x^4/2$$

$$a(3)_n = (m_{lip}(n) + \rho_{reed}A(n))/\Delta t^2 + (\mu_{lip}(n) + \mu_{reed}(n))/2\Delta t - E_{reed}I''/\Delta x^2 + 3E_{reed}I'/\Delta x^3 + 3E_{reed}I/\Delta x^4$$

$$b(3)_n = 2(m_{lip}(n) + \rho_{reed}A(n))/\Delta t^2 + E_{reed}I''/\Delta x^2 - 3E_{reed}I'/\Delta x^3 - 3E_{reed}I/\Delta x^4 - k_{lip}(n)$$

$$a(4)_n = -b(4) = E_{reed}I''/\Delta x^2/2 - 6E_{reed}I'/\Delta x^3/2 - 4E_{reed}I/\Delta x^4/2$$

$$a(5)_n = -b(5) = 2E_{reed}I'/\Delta x^2/2 + E_{reed}I/\Delta x^4/2$$

$$c(1)_n = -(m_{lip}(n) + \rho_{reed}A(n))^2 + (\mu_{lip}(n) + \mu_{reed}(n))/2\Delta t$$

Assuming that the reed $M_R$ is fixed to the mouthpiece $M_P$ at a position N as shown in FIG. 5, y(N, i) and y(N+1, i) become zero at a given time point i. Further, because acceleration ($\partial^2 y(\mathbf{0}, i)/\partial x^2$) and sheer force ($\partial^3 y(\mathbf{0}, i)/\partial x^3$) become zero at the distal end of the reed $M_R$ where no external force acts (n=0), the following Equation B4_1 and Equation B4_2 are established:

$$\begin{aligned} &\frac{\partial^2 y(0,\ i)}{\partial x^2} = \frac{y(2,\ i) - 2y(1,\ i) + y(0,\ i)}{\Delta x^2} = 0 \\ &\rightarrow y(0,\ i) - 2y(1,\ i) + y(2,\ i) = 0 \end{aligned} \quad \text{B4_1}$$

-continued $$\frac{\partial^3 y(0,i)}{\partial x^3} = \frac{y(3,i) - 3y(2,i) + 3y(1,i) - y(0,i)}{\Delta x^3} \quad \text{B4_2}$$

$$\rightarrow -y(0,i) + 3y(1,i) - 3y(2,i) + y(3,i) = 0$$

Further, the following Equation B4_3 is derived by adding together Equation B4_1 and Equation B4_2, and the following Equation B4_4 is derived by subtracting Equation B4_2 from three times of Equation B4_3.

$$0 \cdot y(0,i) + y(1,i) - 2y(2,i) + y(3,i) = 0 \quad \text{B4_3}$$

$$y(0,i) + 0 \cdot y(1,i) - 3y(2,i) + 2y(3,i) = 0 \quad \text{B4_4}$$

Further, the following Equation B4_5 is derived by substituting 2 into n in Equation B4 above.

$$a(1)_2 y(0,i+1) + a(2)_2 y(1,i+1) + a(3)_2 y(2,i+1) + a(4)_2 y(3,i+1) + a(5)_n y(4,i+1) = -\{a(1)_2 y(0,i) + a(2)_2 y(1,i) - b(3)_2 y(2,i) + a(4)_2 y(3,i) + a(5)_2 y(4,i)\} + c(1)_2 y(2,i-1) + k_{lip}(n) y_b(n) - d_{lip}(n)) + (p(i) - P) b_{reed}(n) \quad \text{B4_5}$$

Further, the following Equation B5 is derived from an equation derived by substituting n=3 to N−1 into Equation B4 and from Equation B4_3 and Equation B4_4.

The Gaussian elimination method is suitable as a solution method for Equation B5 above. Because two rows and two columns in a left upper portion of Equation B5 above constitute a diagonal matrix by Equation B4_3 and Equation B4_4 being derived from Equation B4_1 and Equation B4_2, there can be achieved the benefit that the necessary quantity of arithmetic operations to be performed in the Gaussian elimination method can be reduced.

The second arithmetic operation section 312 calculates displacement y(x, t) of the reed $M_R$ by solving Equation B5 using the displacement ($y_0$(xf), $y_b$(xf)), calculated by the first arithmetic operation section 311, as initial values of the displacement y(x, y) and $y_b$(x). More specifically, the second arithmetic operation section 312 first calculates variables y(0, i+1) to y(N−1, i+1), representing future displacement, in the left side of Equation B5, by not only substituting variables y0(0)-y0(N−1) and y0(2) to y0(N−1), calculated by the first arithmetic operation section 311, into both of the variables y0(0, i) to y0(N−1, i), representing current displacement, in the right side of Equation B5 and variables y(2, i−1) to y(N−1, i−1), representing previous displacement, in the right side of Equation B5 but also substituting the displacement $y_b$(xf), calculated by the first arithmetic operation section 311, into $y_b$(2) to $y_b$(N−1) of Equation B5. Second, in order to advance

B5

$$\begin{bmatrix} 1 & 0 & -3 & 2 & 0 & \cdots & 0 \\ 0 & 1 & -2 & 1 & 0 & \cdots & 0 \\ a(1)_2 & a(2)_2 & a(3)_2 & a(4)_2 & a(5)_2 & & \\ 0 & a(1)_3 & a(2)_3 & a(3)_3 & a(4)_3 & a(5)_3 & \\ & 0 & & & & 0 & \\ & & & a(1)_{N-3} & a(2)_{N-3} & a(3)_{N-3} & a(4)_{N-3} \quad a(5)_{N-3} \\ & & & & a(1)_{N-2} & a(2)_{N-2} & a(3)_{N-2} \quad a(4)_{N-2} \\ & & & & & a(1)_{N-1} & a(2)_{N-1} \quad a(3)_{N-1} \end{bmatrix} \begin{bmatrix} y(0, i+1) \\ y(1, i+1) \\ y(2, i+1) \\ \vdots \\ y(N-1, i+1) \end{bmatrix} = -$$

$$\begin{bmatrix} 0 & 0 & 0 & 0 & 0 & 0 & \cdots & 0 \\ 0 & 0 & 0 & 0 & 0 & 0 & \cdots & 0 \\ a(1)_2 & a(2)_2 & -b(3)_2 & a(4)_2 & a(5)_2 & & & \\ 0 & a(1)_3 & a(2)_3 & -b(3)_3 & a(4)_3 & a(5)_3 & & \\ & 0 & & & & & 0 & \\ & & & a(1)_{N-3} & a(2)_{N-3} & -b(3)_{N-3} & a(4)_{N-3} \quad a(5)_{N-3} \\ & & & & a(1)_{N-2} & a(2)_{N-2} & -b(3)_{N-2} \quad a(4)_{N-2} \\ & & & & & a(1)_{N-1} & a(2)_{N-1} \quad -b(3)_{N-1} \end{bmatrix} \begin{bmatrix} y(0, i) \\ y(1, i) \\ y(2, i) \\ \vdots \\ y(N-1, i) \end{bmatrix} +$$

$$\begin{bmatrix} 0 \\ 0 \\ c(1)_2 . y(2, i-1) \\ c(1)_3 . y(3, i-1) \\ \vdots \\ c(1)_{N-1} . y(N-1, i-1) \end{bmatrix} + \begin{bmatrix} 0 \\ 0 \\ k_{lip}(2)(y_b(2) - d_{lip}(2)) + (p(i) - P) b_{reed}(2) \\ k_{lip}(3)(y_b(3) - d_{lip}(3)) + (p(i) - P) b_{reed}(3) \\ \vdots \\ k_{lip}(N-1)(y_b(N-1) - d_{lip}(N-1)) + (p(i) - P) b_{reed}(N-1) \end{bmatrix}$$

the time by Δt, the second arithmetic operation section 312 calculates variables y(0, i+1) to y(N−1, i+1), representing future displacement in the left side of Equation B5, by solving Equation B5 by not only substituting variables y(2, i) to y(N−1, representing current displacement, into variables y(2, i−1) to y(N−1, i−1), representing previous displacement, in the right side of Equation B5, but also substituting variables y(0, i+1) to y(N−1, i+1), representing last-calculated future displacement, into variables y(0, i) to y(N−1, i), representing current displacement, in the right side of Equation B5. By repeating the above-mentioned arithmetic operations for calculating the displacement y(0, i+1) to y(N−1, i+1) at the time point (i+1) by solving Equation B5 by substituting thereinto the displacement y(0, i) to y(N−1, i) at the time point i, the second arithmetic operation section 312 calculates a change over time of the displacement y(x, t) at each position x of the reed $M_R$.

Further, each time the pressing force $f_{lip}(x)$ set by the setting section 12 changes, the first arithmetic operation section 311 calculates new $y_0(xf)$ and $y_b(xf)$ by substituting the changed pressing force $f_{lip}(x)$ into the pressing force $f_{lip}(xf)$ in Motion Equations A1 and A2. Each time the first arithmetic operation section 311 calculates new displacement $y_b(xf)$, the second arithmetic operation section 312 updates the numerical value to be substituted into $y_b(2)$ to $y_b(N-1)$ with the new displacement $y_b(xf)$. With the aforementioned arrangements, it is possible to synthesize tones faithfully reproducing a style of performance or rendition where the pressing force $f_{lip}(xf)$ is changed as desired. However, even when the first arithmetic operation section 311 has calculated new displacement $y_0(xf)$ in response to a change of the pressing force $f_{lip}(xf)$, the second arithmetic operation section 312 does not reflect the calculated new displacement $y_0(xf)$ for the displacement y(0, i) to y(N−1, i) of Equation 5. Thus, with the aforementioned arrangements, it is possible to avoid any discontinuous change of the displacement y(x, t), so that auditorily natural tones can be generated.

As shown in FIG. 4, the second arithmetic operation section 312 includes a range limiting section 32 that limits the displacement y(x, t) of the reed $M_R$ to within a predetermined range. The range limiting section 32 limits the displacement y(xt) of the reed $M_R$, calculated from Equation B5, to a range from the displacement $y_b(xf)$ of the lip $M_L$ (i.e., position of the bottom surface of the lip $M_L$ which the teeth $M_T$ contacts), calculated by the first arithmetic operation section 311, to the facing position H(x) set by the setting section 12. Namely, when the displacement y(x, t) of the reed $M_R$ exceeds the displacement $y_b(xf)$ in the case where the value of downward displacement, in the Y direction, of the reed $M_R$ exceeds that of the lip $M_L$ is considered to be positive), the range limiting section 32 changes the displacement y(x, t) to the displacement $y_b(xf)$, but when the displacement y(x, t) of the reed $M_R$ exceeds (falls below) the facing position H(x), the range limiting section 32 changes the displacement y(x, t) to the facing position H(x). With the aforementioned arrangements, it is possible to avoid simulation of an absurd situation where the reed $M_R$ is located beneath the bottom surface of the lip $M_L$ or above the mouthpiece $M_P$. The displacement $y_b(x)$ of the bottom surface of the lip $M_L$ has been described above as the upper limit value of the displacement y(x, t) of the reed $M_R$, but, because the lip $M_L$ has a thickness, a given position closer to the facing position H(x) than the displacement $y_b(x)$ by a predetermined value corresponding to the thickness of the lip $M_L$ (e.g., a fixed value corresponding to a minimum value of the thickness of the lip $M_L$, or a variable value corresponding to a minimum value of the thickness of the lip $M_L$ and variable in accordance with the pressing force $f_{lip}(x)$).

Note that the same method as used for the calculation, by the second arithmetic operation section 312, of the displacement y(x, t) is used for the calculation, by the first arithmetic operation section 311, of the displacement y0(x) (i.e., solution for Motion Equation A1), as outlined below. Motion Equation A1 is transformed into the following Difference Equation A1_A1 in a similar manner to the above-mentioned transformation from Motion Equation B1 to Equation B2.

$$E_{reed}\left\{I'' \cdot \frac{y(n+1)-2y(n)+y(n-1)}{(\Delta x)^2}\right\} + E_{reed}\left\{2I' \cdot \frac{y(n+2)-3y(n+1)+3y(n)-y(n-1)}{(\Delta x)^3}\right\} + E_{reed}\left\{I \cdot \frac{(y(n+2)-4y(n+1)+6y(n)-4y(n-1)+y(n-2)}{(\Delta x)^4}\right\} = f_{lip}(n) \quad \text{A1_1}$$

If the individual terms in Equation A1_A1 are rearranged per type of the variable y, the following Equation A1__2 can be derived:

$$a(1)_n y(n-2)+a(2)_n y(n-1)+a(3)_n y(n)+a(4)_n y(n+1)+a(5)_n y(n+2)=f_{lip}(n) \quad \text{A1_2}$$

Note, however, that the individual terms in Equation A1__2 are ones previously substituted as follows:

$$a(1)_n=E_{reed}I/\Delta x^4$$

$$a(2)_n=E_{reed}I''/\Delta x^2-2E_{reed}I'/\Delta x^3-4E_{reed}I/\Delta x^4$$

$$a(3)_n=-2E_{reed}I''/\Delta x^2+6E_{reed}I'/\Delta x^3+6E_{reed}I/\Delta x^4$$

$$a(4)_n=E_{reed}I''/\Delta x^2-6E_{reed}I'/\Delta x^3-4E_{reed}I/\Delta x^4$$

$$a(5)_n=2E_{reed}I'/\Delta x^3+E_{reed}I/\Delta x^4$$

Equation A1__2 is transformed into the following Difference Equation A1__3 in a similar manner to the above-mentioned transformation from Equation B4 to Equation B5.

$$\begin{bmatrix} 1 & 0 & -3 & 2 & 0 & \cdots & 0 \\ 0 & 1 & -2 & 1 & 0 & \cdots & 0 \\ a(1)_2 & a(2)_2 & a(3)_2 & a(4)_2 & a(5)_2 & & \\ 0 & a(1)_3 & a(2)_3 & a(3)_3 & a(4)_3 & a(5)_3 & \\ & \ddots & \ddots & \ddots & \ddots & \ddots & \ddots \\ & & & a(1)_{N-3} & a(2)_{N-3} & a(3)_{N-3} & a(4)_{N-3} & a(5)_{N-3} \\ & & & & a(1)_{N-2} & a(2)_{N-2} & a(3)_{N-2} & a(4)_{N-2} \\ & & & & & a(1)_{N-1} & a(2)_{N-1} & a(3)_{N-1} \end{bmatrix} \begin{bmatrix} y(0) \\ y(1) \\ y(2) \\ \vdots \\ y(N-1) \end{bmatrix} = \begin{bmatrix} 0 \\ 0 \\ f_{lip}(2) \\ f_{lip}(3) \\ \vdots \\ f_{lip}(N-1) \end{bmatrix} \quad \text{A1_3}$$

The first arithmetic operation section 311 calculates displacement y0(x) (y(0) to y(N−1) in Equation A1_3) using the Gaussian elimination method or the like. The foregoing has been a specific example of the solution for Motion Equation A1.

The third arithmetic operation section 313 of FIG. 4 calculates a volume flow rate f(t) in the immediately-above-reed portion on the basis of the parameters H(x), $\rho_{air}$, $b_{reed}(x)$ and $Z_c$ set by the setting section 12 and the displacement y(x, t) calculated by the second arithmetic operation section 312. The third arithmetic operation section 313 in the instant embodiment calculates, as the volume flow rate f(t) of the immediately-above-reed portion, a difference value between a volume flow rate U(t) resulting from a pressure difference between the upper and lower surfaces of the reed $M_R$, and a volume flow rate u(t) resulting from displacement (y(x, t)) of various portions of the reed $M_R$ (namely, f(t)=U(t)−u(t)).

The volume flow rate u(t) can be expressed by the following Equation C1, where "$l_{eff}$ represents a distance from the distal end to the supporting point of the reed $M_R$ (i.e., effective length of the reed $M_R$).

$$u(t)=\int_0^{l_{eff}} b_{reed}(x)\dot{y}(x,t)dx \qquad \text{C1}$$

The third arithmetic operation section 313 calculates the volume flow rate u(t) by substituting into Equation C1 the width $B_{reed}(x)$ of the reed $M_R$ set by the setting section 12 and a time derivative of the displacement y(x, t) (i.e., velocity of the reed $M_R$) calculated by the second arithmetic operation section 312 to perform numeric integration, such as the Simpson's method.

Further, the volume flow rate U(t) can be calculated in accordance with the following arithmetic operational sequence. First, the third arithmetic operation section 313 calculates a gap ξ(t) [m] between the mouthpiece $M_P$ and the reed $M_R$ at the distal end of the reed $M_R$. More specifically, the gap ξ(t) calculates, as the gap ξ(t), a difference between displacement y(0, t) of the distal end (x=0) of the reed $M_R$ of the displacement y(x, t) of the reed $M_R$, calculated by the second arithmetic operation section 312, and a facing position H(0) at the distal end (x=0) (i.e., gap ξ(t)=y(0, t)−H(0)).

Then, the third arithmetic operation section 313 calculates effective mass M(t) [Kg] of air passing through the gap between the mouthpiece $M_P$ and the reed $M_R$. The effective mass M(t) can be expressed by the following equation C2:

$$M(t) = \frac{\rho_{air}\sqrt{R(t)}}{2\pi b_{reed}(0)}(1 + 2\log 2R(t)), \qquad \text{C2}$$

where R(t) represents a relative ratio between the horizontal width $B_{reed}(\mathbf{0})$ and the gap ξ(t) at the distal end of the reed $M_R$ (i.e., ration R(t)=$B_{reed}(\mathbf{0})$/ξ(t)). Namely, the third arithmetic operation section 313 calculates effective mass M(t) by substituting into Equation C2 the horizontal width $B_{reed}(\mathbf{0})$ and air density ρ air of the reed $M_R$, set by the setting section 12, and the relative ratio R(t).

For the effective mass M(t) and volume flow rate U(t), the following Equation C3 is established:

$$M(t)\dot{U}(t) = P - p(t) - \frac{U(t)^{5/2}}{|U(t)|A^{3/2}\cdot\xi(t)^2}, \qquad \text{C3}$$

where A represents a predetermined coefficient (e.g., A=0.0797). The following method is used in the calculation of the volume flow rate U(t) using Equation C3 above.

Equation C3 can be transformed into the following Equation C4 using Equation D1 and Equation D2 to be described later:

$$M(t)\dot{U}(t) = P - 2P_{in}(t) - Z_c(U(t) - u(t)) - \frac{U(t)^{5/2}}{|U(t)|A^{3/2}\cdot\xi(t)^2} \qquad \text{C4}$$

If the derivative in Equation C4 above is discretized with a backward difference, the following Equation C5 is derived. The third arithmetic operation section 313 calculates the volume flow rate U(t) from Equation C5 using a numerical solution of nonlinear equations (e.g., Newton-Raphson method).

$$\alpha U_n|U_n|^{1/2} + \beta U_n - \gamma = 0 \qquad \text{C5}$$

$$\alpha = A^{-3/2}$$

$$\beta = \left(\frac{M_n}{\Delta t} + Z_c\right)\xi^2$$

$$\gamma = \left(P - 2P_{in} - Z_c u_n + M_n\frac{U_{n-1}}{\Delta t} + Z_c\right)\xi^2$$

The third arithmetic operation section 313 calculates, as a volume flow rate f(t), a difference between the volume flow rate U(t) and the volume flow rate (t) calculated in accordance with the above-described arithmetic operation sequence.

The fourth arithmetic operation section 314 of FIG. 4 calculates output wave pressure $P_{OUT}(t)$ and sound pressure p(t) of the immediately-above-reed portion p(t). The output wave pressure $P_{OUT}(t)$ is pressure of a sound wave traveling forward from the reed $M_R$ through the interior of the tubular body portion (hereinafter referred to as "output wave"). Portion of the sound wave traveling from the reed $M_R$ through the interior of the tubular body reflects off an open end (bell) of the wind instrument, and then that portion having traveled through the interior of the tubular body (hereinafter referred to as a "reflected wave") travels backward through the interior of the tubular body to reach the interior of the mouthpiece $M_P$. Thus, the output wave pressure $P_{OUT}(t)$ corresponds to a sum of pressure produced by the volume flow rate f(t) and pressure $P_{IN}$ of the reflected wave traveling from the interior of the tubular body to the mouthpiece $M_P$ (this pressure will be referred to as "reflected wave pressure $P_{IN}$"). The reflected wave pressure $P_{IN}$ is calculated or arithmetically determined by the tubular body simulating section 33.

Because the pressure produced by the volume flow rate f(t) is a product between the volume flow rate f(t) and the characteristic impedance $Z_c$, the output wave pressure $P_{OUT}(t)$ can be expressed by the following equation D1:

$$P_{OUT}(t)=Z_c\cdot f(t)+P_{IN}(t) \qquad \text{D1}$$

The fourth arithmetic operation section 314 calculates the output wave pressure $P_{OUT}(t)$ by substituting into Equation D1 above the characteristic impedance $Z_c$ set by the setting section 12, volume flow rate f(t) calculated by the third arithmetic operation section 313 and reflected wave pressure $P_{IN}$ calculated by the tubular body simulating section 33.

Because the output wave pressure $P_{OUT}(t)$ and reflected wave pressure $P_{IN}$ act on the immediately-above-reed portion, the sound pressure p(t) of the immediately-above-reed portion p(t) can be expressed by the following Equation D2:

$$P(t)=P_{OUT}(t)+P_{IN}(t) \qquad \text{D2}$$

The fourth arithmetic operation section 314 calculates the pressure P(t) by substituting into Equation D2 above the output wave pressure $P_{OUT}(t)$ calculated on the basis of Equation D1 and reflected wave pressure $P_{IN}(t)$ calculated by the tubular body simulating section 33. The pressure P(t) calculated by the fourth arithmetic operation section 314 is fed back to the calculation (Equation B) of the external force $f_{ex}(x)$ by the second arithmetic operation section 312 and calculation (Equation C) of the volume flow rate U(t) by the third arithmetic operation section 313.

Figure 6:
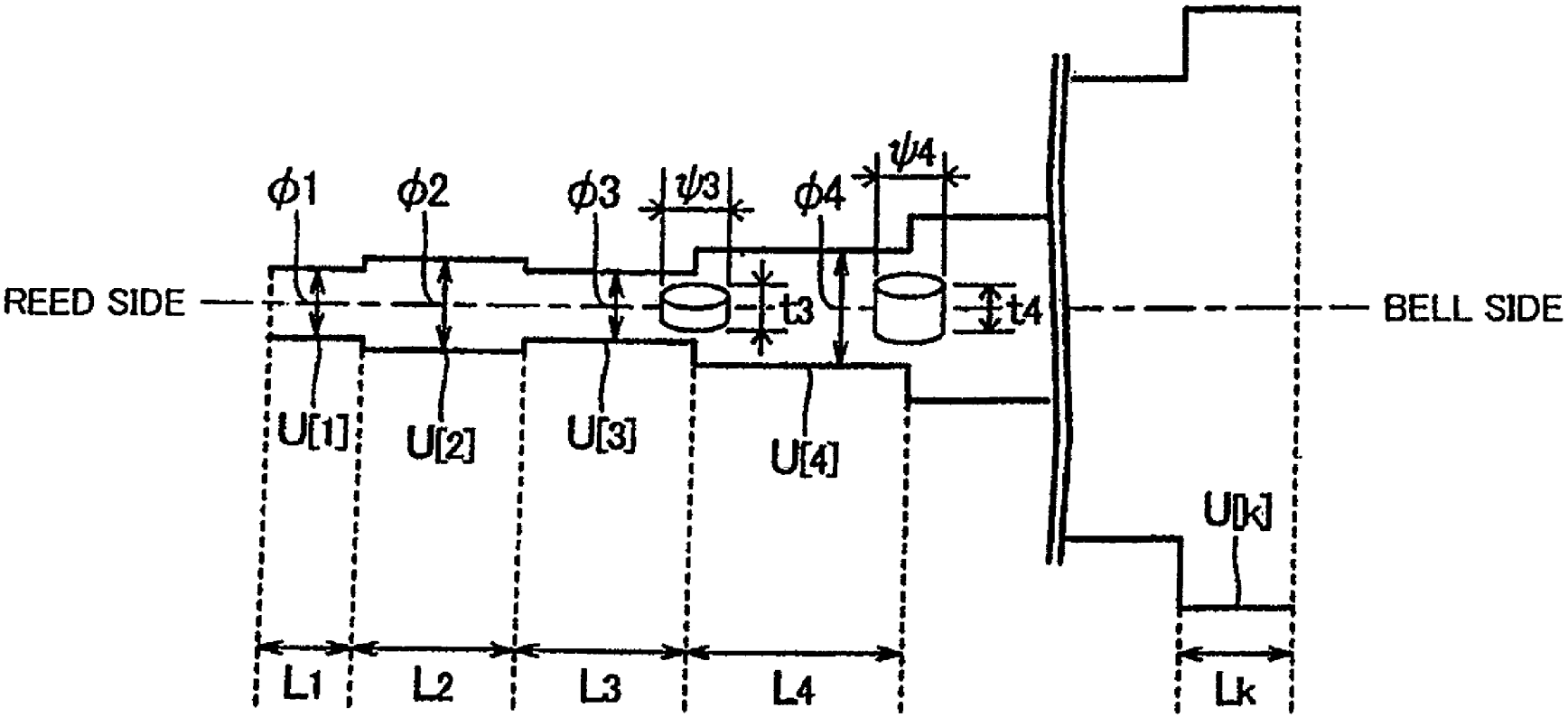
FIG. 6 is a schematic representation of a tubular body portion of the wind instrument.

Next, a description will be given about the functions of the tubular body simulating section 33. As shown in FIG. 6, a tubular body section (extending from the mouthpiece to the bell) of an actual wind instrument can be approximated by a structure comprising k (k is a natural number) tubular unit portions U (U[1]-U[k]) connected together in series. Diameters and overall lengths of the individual tubular unit portions (namely, shape of each of the tubular body portions) are variably set. The tubular body simulating section 33 realizes behavior of a sound wave inside the tubular body portion by use of a physical model (hereinafter referred to as "tubular body model") simulating the structure of FIG. 6.

Figure 7:
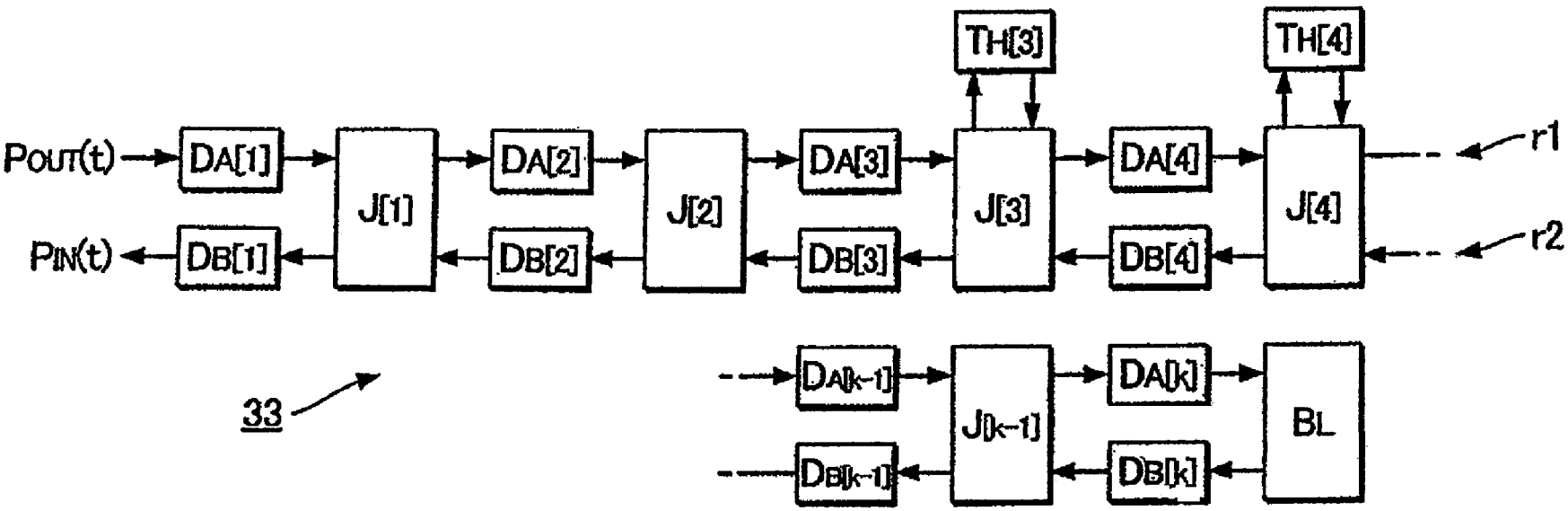
FIG. 7 is a block diagram showing an example construction of a tubular body model employed in the first embodiment.

FIG. 7 is a block diagram showing an example construction of the tubular body model used by the tubular body simulating section 33. As shown in FIG. 7, the tubular body model includes: delay elements $D_A$ ($D_A$[1]-$D_A$[k]) provided on a path r1 in corresponding relation to the unit portions U; delay elements $D_B$ ($D_B$[1]-$D_B$[k]) provided on a path r2 in corresponding relation to the unit portions U, junctions or connecting sections J (J[1]-J[k−1]) provided between adjacent ones of the delay elements $D_A$ and between adjacent ones of delay elements $D_B$; hole portions $T_H$ ($T_H$[1]-$T_H$[k−1]) connected to some of the connecting sections J which are located at positions corresponding to tone holes of the wind instrument; and a bell section BL corresponding to the bell of the wind instrument. The path r1 simulates behavior of an output wave traveling through the interior of the tubular body portion from the mouthpiece $M_P$ to the bell (i.e., output wave pressure $P_{OUT}(k, t)$), while the path r2 simulates behavior of an output wave traveling through the interior of the tubular body portion from the bell to the mouthpiece $M_P$ (i.e., reflected wave pressure $P_{IN}(k, t)$).

The delay element DA[i] of an i (i=1−k)-th stage is an element for delaying output wave pressure $P_{OUT}(i, t)$, supplied from a preceding stage, by a predetermined delay amount $d_A[i]$; for example, it is a shift register that differs in the number of stages in accordance with the delay amount $d_A[i]$. Output wave pressure $P_{OUT}(t)$ calculated by the reed simulating section 31 (fourth arithmetic operation section 314) is supplied, as an initial value $P_{OUT}(1, t)$, to the delay element DA[1] of the first stage to be sequentially delayed by the delay elements $D_A$[1]-$D_A$[k] of the individual stages, and then reaches the bell section $B_L$. Namely, the delay element DA[i] simulates a propagation delay of the output wave pressure $P_{OUT}(i, t)$ in the i-th unit portion U[i].

Figure 8:
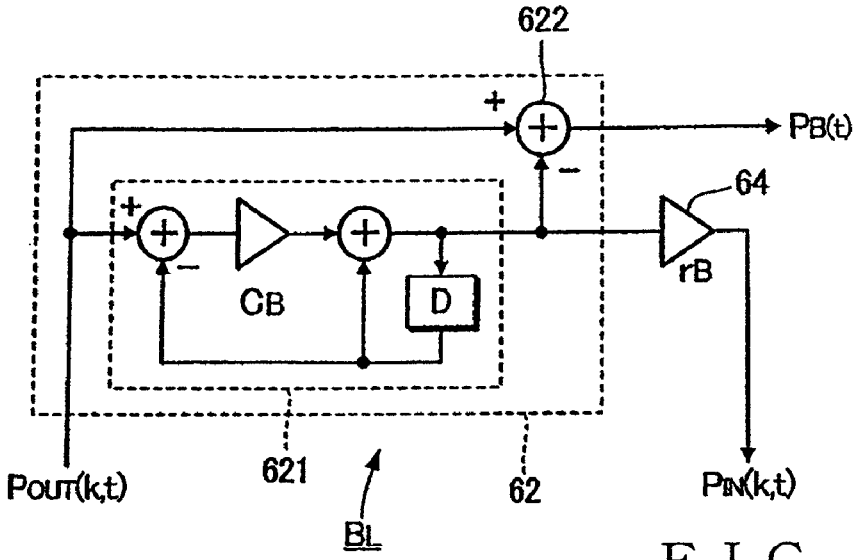
FIG. 8 is a block diagram of a bell section in the tubular body model.

The bell section $B_L$ simulates radiation of a sound wave from the bell of the wind instrument and reflection of the sound wave at the distal end of the bell. A shown in FIG. 8, the bell section $B_L$ includes a filter section 62 and a multiplication section 64. Output wave pressure $P_{OUT}(k, t)$ output from the delay element $D_A$[k] of the k-th stage (i.e., last stage) on the path r1 is supplied to the bell section $B_L$. The filter section 62 includes a low-pass filter portion 621 and a subtraction portion 622. The low-pass filter portion 621 filters out components of a time waveform of the output wave pressure $P_{OUT}(k, t)$, output from the k-th stage delay element $D_A$[k], which exceed a cutoff frequency $f_{CB}$. Multiplied value $C_B$ of a multiplier in the low-pass filter portion 621 is a value that satisfies $C_B=2\pi\cdot f_{CB}\cdot\Delta t$. The subtraction portion 622 calculates radiated sound pressure $P_B(t)$ by subtracting the output of the low-pass filter portion 621 from the output wave pressure $P_{OUT}(k, t)$ of the k-th stage delay element $D_A$[k]. Namely, the subtraction portion 622 functions as a high-pass filter that filters out components of the output wave pressure $P_{OUT}(k, t)$ which fall below the cutoff frequency $f_{CB}$. The radiated sound pressure $P_B(t)$ is equivalent to pressure of the sound wave radiated from the bell.

The multiplication section 64 simulates reflection of a sound wave at a boundary between inner and outer sides of the bell of the wind instrument. Namely, the multiplication section 64 calculates reflected wave pressure $P_{IN}(k, t)$ by multiplying the output from the low-pass filter portion 621 by a coefficient $r_B$ and then outputs the calculated reflected wave pressure $P_{IN}(k, t)$ to the path r2 (more specifically, to the delay element $D_B$[k] of FIG. 7). Because the sound wave reverses its phase and causes some loss at the time of the reflection, the coefficient $r_B$ is set at a negative number whose absolute value is, for example, smaller than one.

Similarly to the delay element DA[i], the delay element $D_B$[i] of FIG. 7 delays reflected wave pressure $P_{IN}(i, t)$, input from a preceding stage (closer to the bell section $B_L$), by a predetermined delay amount $d_B$[i]. Namely, the delay element $D_B$[i] simulates a propagation delay of the reflected wave pressure $P_{IN}(k, t)$ in the i-th unit portion U[i]. The reflected wave pressure $P_{IN}(k, t)$ calculated by the bell section $B_L$ are sequentially delayed by the delay elements $D_B$[k]-$D_B$[1], and the reflected wave pressure $P_{IN}(1, t)$ output from the first-stage delay element $D_B$[1] is used, as reflected wave pressure $P_{IN}(t)$, in arithmetic operations by the reed simulating section 31 (fourth arithmetic operation section 314).

The connecting section (or junction) J simulates output wave diffusion and energy loss arising from inner diameter variation of the tubular body portion. The connecting section (or junction) J may be of either a two-port type as shown in (A) of FIG. 9 or a three-port type as shown in (B) of FIG. 9. The two-port type connecting section J[i] includes: a multiplication section 71 for multiplying output wave pressure $P_{OUT}(i, t)$, supplied via the path r1, by a coefficient $\alpha i$; a multiplication section 72 for multiplying reflected wave pressure $P_{IN}(i+1, t)$, supplied via the path r2, by a coefficient $\beta_i$; an addition section 73 for adding together an output ($\alpha i\cdot P_{OUT}(i, t)$) from the multiplication section 71 and an output ($\beta i\cdot P_{IN}(i+, t)$) from the multiplication section 72; a subtraction section 74 for outputting a difference between the output from the addition section 73 and the output wave pressure $P_{OUT}(i, t)$ to the path r2 as new reflected wave pressure $P_{IN}(i, t)$; and a subtraction section 75 for outputting a difference between the output from the addition section 73 and the reflected wave pressure $P_{IN}(i+1, t)$ to the path r1 as new output wave pressure $P_{OUT}(i+1, t)$. Such a two-port type connecting section J[i] is employed where no tone hole portion $T_H$ is connected, such as the connecting sections J[1] and J[2] shown in FIG. 7.

Figure 9:
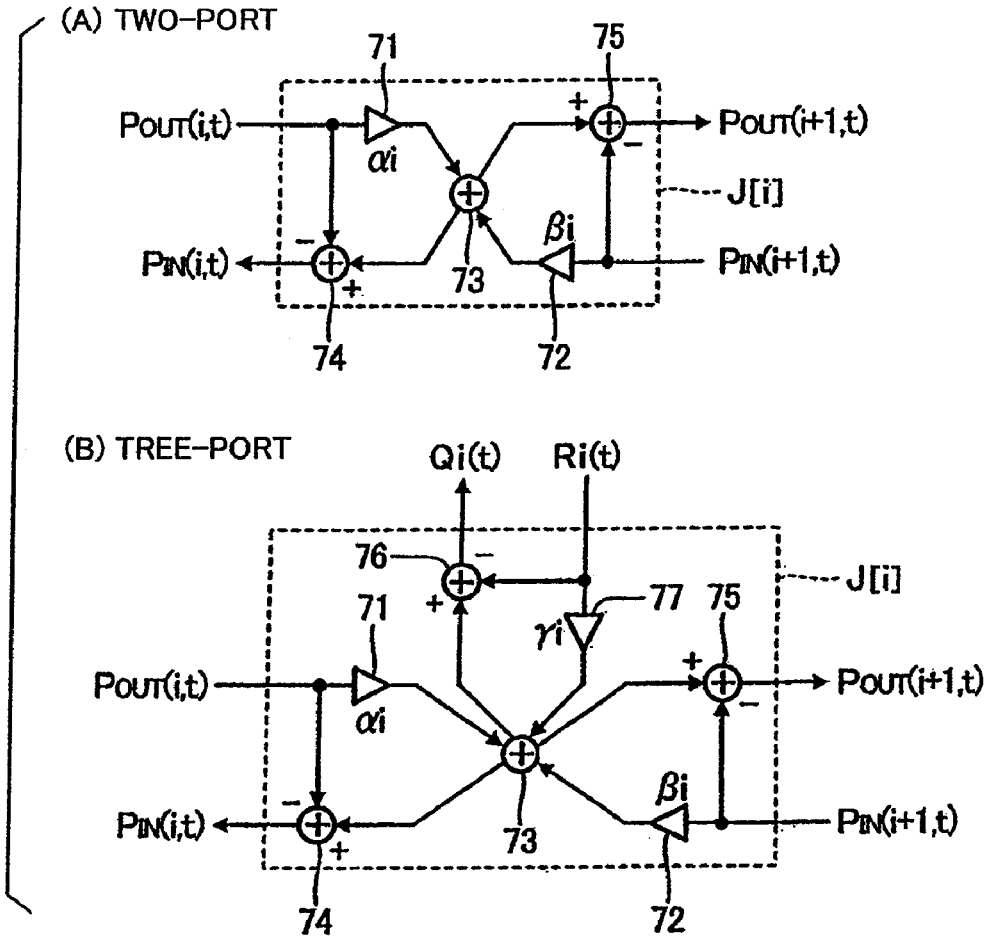
FIG. 9 is a block diagram of a connecting section in the tubular body model.

The three-port type connecting section J[i] shown in (B) of FIG. 9 is employed where a tone hole portion $T_H$ is connected, such as the connecting sections J[3] and J[4] shown in FIG. 7. The three-port type connecting section J[i] includes, in addition to the aforementioned components of the two-port type connecting section J[i], a subtraction section 76 for outputting a difference between the output from the addition section 73 and sound pressure $R_i(t)$ output from the i-th tone hole portion $T_H$[i] to the tone hole portion $T_H$[i] as sound pressure $Q_i(t)$, and a multiplication section 77 for multiplying the sound pressure $R_i(t)$ by a coefficient $\gamma i$.

Figure 10:
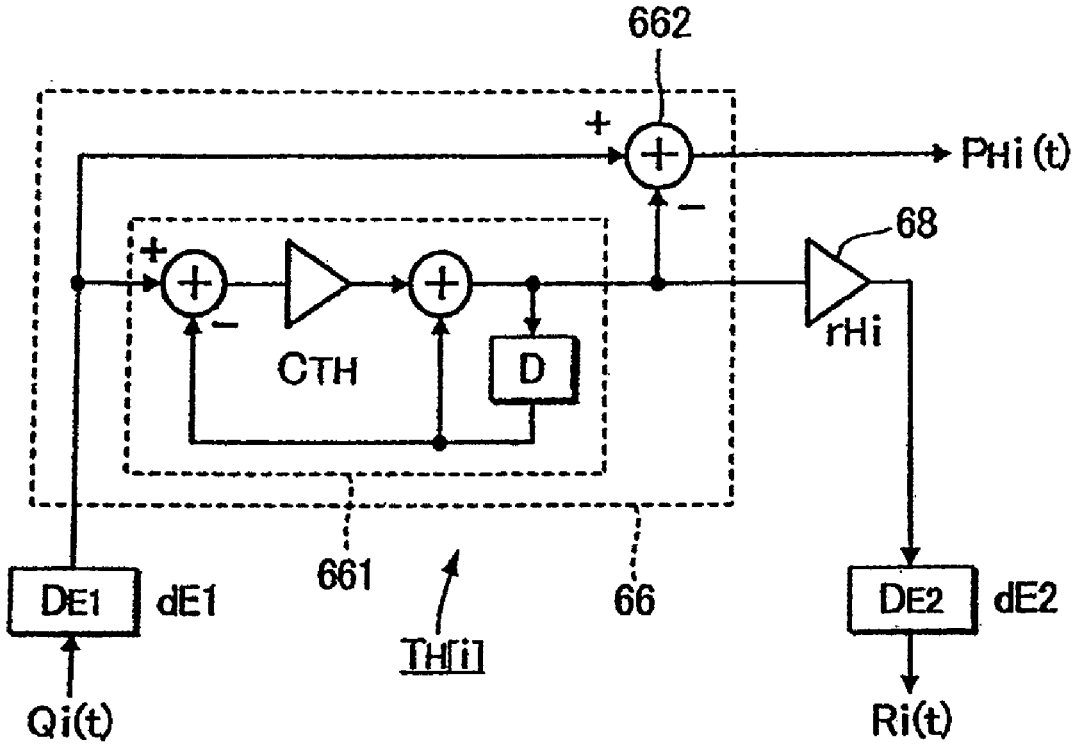
FIG. 10 is a block diagram of a tone hole portion in the tubular body model.

The tone hole portion $T_H$[i] simulates radiation of a sound wave from an i-th tone hole and reflection of the sound wave at the tone hole. As shown in FIG. 10, the tone hole portion $T_H$[i] includes delay elements $D_E$1 and $D_E$2, a filter section 66 and a multiplication section 68, similarly to the bell section BL of FIG. 8. The delay element $D_E$1 delays sound pressure $Q_i(t)$, supplied from the three-port connecting second J[i], by a delay amount dE1. The filter section 66 includes a low-pass filter section 661 for filtering out components of the delayed sound pressure $Q_i(t)$ which exceed a cutoff frequency $f_{CTH}$, and a subtraction section (high-pass filter) 662 for calculating radiated sound pressure $P_{Hi}(t)$ by subtracting the output of the low-pass filter section 661 from the sound pressure $Q_i(t)$. Multiplicities value $C_{TH}$ of a multiplier in the low-pass filter portion 661 is a value that satisfies $C_{TH}=2\pi\cdot f_{CTH}\cdot\Delta t$. The radiated sound pressure $P_{Hi}(t)$ is equivalent to pressure of the sound wave radiated from the i-th tone hole. The multiplication section 68 calculates sound pressure $R_i(t)$ by multiplying the output of the low-pass filter section 661 by a coefficient $rH_i$ (e.g., positive or negative number whose absolute value is, for example, below one), in order to simulate a situation where phase inversion does not occur when the i-th tone hole is closed or where sound wave loss and phase inversion occur when the tone hole is opened. Namely, the multiplication section 68 simulates reflection of a sound wave at a boundary between inside and outside of the tone hole. The sound pressure $R_i(t)$ is delayed by the delay element $D_E$2 by a delay amount $d_E$2 and then output to the three-port connecting section J[i] (multiplication section 77). The foregoing has been a discussion of the functions of the tubular body simulating section 33.

Figure 11:
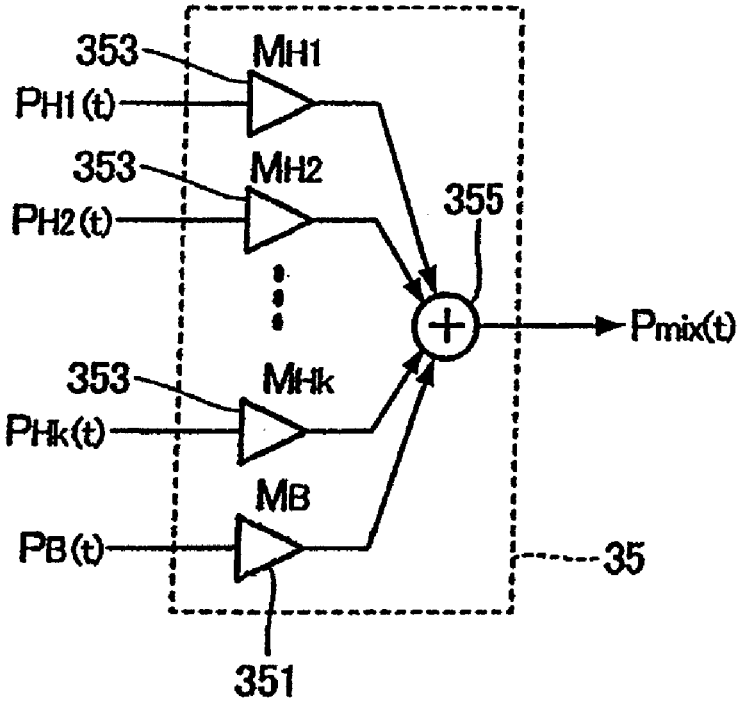
FIG. 11 is a block diagram of a transmission simulating section.

The transmission simulating section 35 of FIG. 1 simulates impartment of transmission characteristics to radiated sounds from the bell and individual tone holes of the wind instrument. As shown in FIG. 11, the transmission simulating section 35 includes a multiplication section 351 corresponding to the bell, k multiplication sections 353 corresponding to the unit portions U[1]-U[k], and an addition section 355 for adding together the outputs of the multiplication section 351 and k multiplication sections 353. The multiplication section 351 multiplies sound pressure $P_B(t)$, calculated by the bell section $B_L$, by a coefficient $M_B$. The i-th multiplication section 353 multiplies radiated sound pressure $P_{Hi}(t)$, calculated by the tone hole portion $T_H[i]$, by a coefficient $M_{Hi}$. The coefficient $M_{Hi}$ is set at 0 when the i-th tone hole is closed or not provided in the wind instrument, but set at a predetermined value greater than 0, such as 1, when the i-th tone hole is opened. Thus, listening sound pressure $P_{mix}(t)$ calculated by the addition section 355 represents sound pressure of a sound wave (listening sound) comprising a mixture of the radiated sound from the bell and radiated sound from a tone hole that is opened by a human player. The listening sound pressure $P_{mix}(t)$ is output, as tone data, from the arithmetic operation processing device 10 to the sounding device 46.

Next, a description will be given about the setting section 12. As shown in FIG. 1, the setting section 12 includes a characteristic parameter conversion section 21 and a shape characteristic parameter conversion section 23. The characteristic parameter conversion section 21 converts various parameters, pertaining to characteristics of the reed $M_R$ and lip $M_L$, to parameters necessary for tone synthesis. The shape characteristic parameter conversion section 23 converts various parameters, pertaining to the shape and dimensions of the wind instrument, to parameters necessary for tone synthesis.

Figure 12:
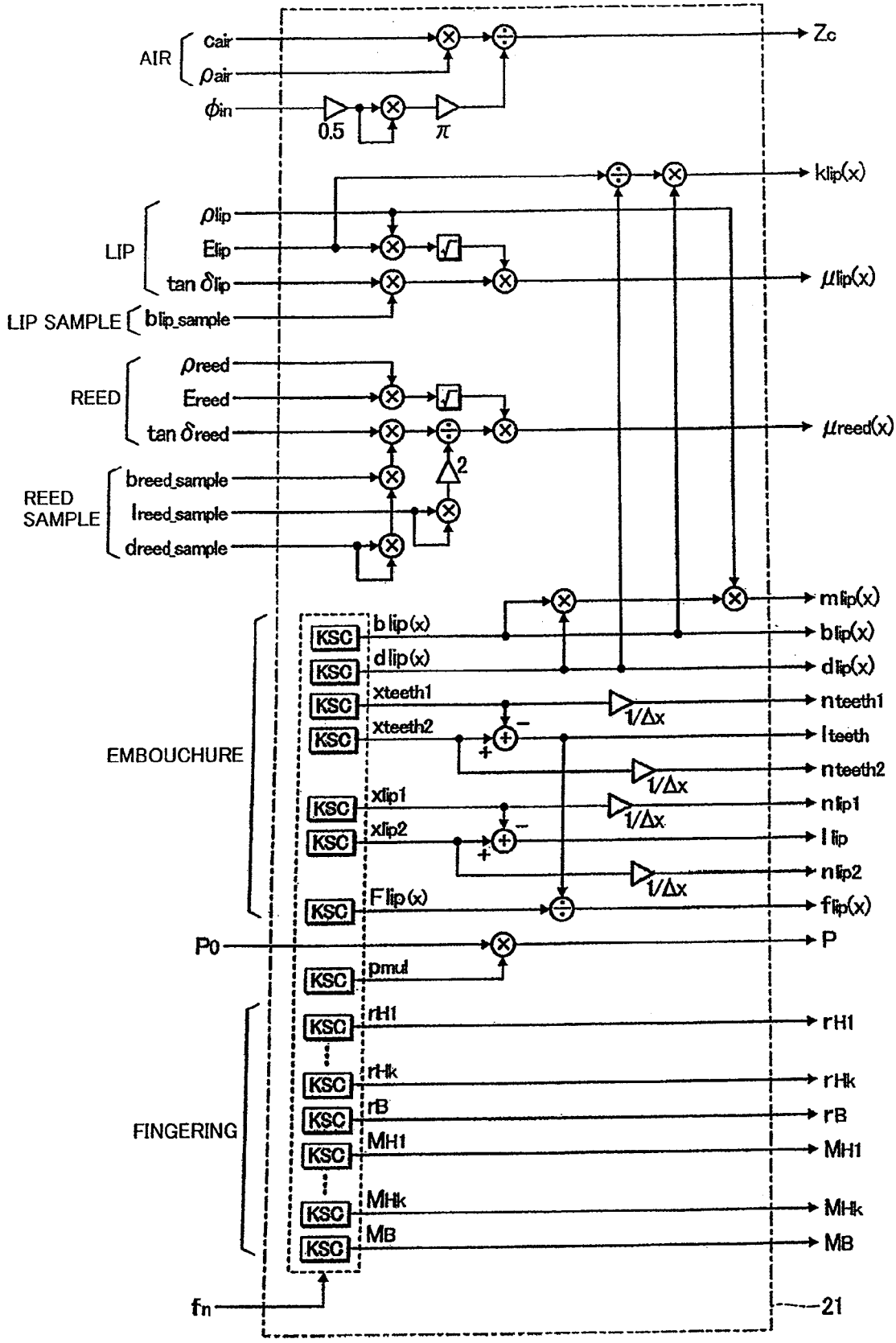
FIG. 12 is a block diagram of a characteristic parameter conversion section.

FIG. 12 is a block diagram showing specific functions of the characteristic parameter conversion section 21. The user operates the input device 44 to input or designate various parameters, listed in a left region of FIG. 12, to the arithmetic operation processing device 10.

Among such parameters designated by the user are physical property values pertaining to air (i.e., $C_{air}$ and $\rho_{air}$), physical property values pertaining to the lip $M_L$ ($\rho_{lip}$, $E_{lip}$ and $_{tan\ \delta\ lip}$), a dimension pertaining to a particular sample of the lip (hereinafter referred to as "lip sample") ($b_{lip_sample}$), physical property values pertaining to the reed $M_R$ ($\rho_{reed}$, $E_{reed}$ and $_{tan\ \delta\ reed}$), dimensions pertaining to a particular sample of the reed (hereinafter referred to as "reed sample") ($b_{reed_sample}$, $l_{reed_sample}$ and $d_{reed_sample}$), breath pressure $P_0$, and tone pitch $f_n$.

The parameter $C_{air}$ represents the sound speed [m/sec] in air, and the parameter $\rho_{air}$ represents the density [kg/m$^3$] of air. The breath pressure $P_0$ represents air pressure within the mouth cavity of the user or human player during a performance of the wind instrument. The tone pitch $f_n$ is a numerical value indicative of a pitch of a tone to be synthesized by the arithmetic operation processing device 10. Desired performance tone can be synthesized by appropriately changing the tone pitch $f_n$.

The physical property values pertaining to the lip $M_L$ includes density $\rho_{lip}$ [kg/m$^3$] of the lip $M_L$, Young's modulus $E_{lip}$ [Pa] of the lip $M_L$, and loss coefficient $_{tan\ \delta\ lip}$ of the lip $M_L$. The physical property values pertaining to the lip sample include a width (i.e., dimension in the Z direction) $b_{lip_sample}$ [m]. The lip sample is a structure made of a material which has generally the same physical characteristics as an actual human lip but is different from the actual human lip in that it is simplified in shape into a plain three-dimensional shape (rectangular parallelepiped in the illustrated example). Thus, the horizontal width (i.e., dimension in the Z direction) $b_{lip_sample}$ is a fixed value that does not depend on the position in the X direction. In place of the aforementioned arrangement where the user individually inputs the physical property values and dimensions pertaining to the lip $M_L$ and lip sample, the instant embodiment may employ an arrangement where values of the individual parameters ($\rho_{lip}$, $E_{lip}$, $_{tan\ \delta\ lip}$ and $b_{lip_sample}$) are stored in advance in the storage device 42 in association with a plurality of types of lips $M_L$ so that the characteristic parameter conversion section 21 can acquire, from the storage device 42, values of the parameters pertaining to a particular type of lip $M_L$ selected by the user via the input device 42.

The physical property values pertaining to the reed $M_R$ include density $\rho_{reed}$ [kg/m$^3$] of the reed $M_R$, Young's modulus $E_{reed}$ [Pa] of the reed $M_R$, and loss coefficient $_{tan\ \delta\ reed}$ of the reed $M_R$. The physical property values pertaining to the reed sample include a horizontal width (i.e., dimension in the Z direction) $b_{reed_sample}$ [m], a length (i.e., dimension in the X direction) $l_{reed_sample}$ [m], and a thickness (i.e., dimension in the Y direction) $d_{reed_sample}$ [m]. The reed sample is a structure made of a material which has generally the same physical characteristics as an actual reed but is different from the actual reed in that it is simplified in shape into a plain three-dimensional shape (rectangular parallelepiped in the illustrated example). Thus, the physical property values ($b_{reed_sample}$, $l_{reed_sample}$ and $d_{reed_sample}$) pertaining to the reed are fixed values. In place of the aforementioned arrangement where the user individually inputs the physical property values and dimensions pertaining to the reed $M_R$ and reed sample, the instant embodiment may employ an arrangement where values of the individual parameters ($\rho_{reed}$, $E_{reed}$, $_{tan\ \delta\ reed}$, $b_{reed_sample}$ and $l_{reed_sample}$) are stored in advance in the storage device 42 in association with a plurality of types of reeds $M_R$ so that the characteristic parameter conversion section 21 can acquire, from the storage device 42, values of the parameters pertaining to a particular type of reed $M_R$ selected by the user via the input device 42.

The characteristic impedance $Z_c$ of the mouthpiece $M_P$ of the wind instrument can be expressed by the following Mathematical $$Z_c = (\rho_{air} \cdot c_{air}) / \mathrm{Sin} \quad (a1)$$
$$= (\rho_{air} \cdot c_{air}) / \{\pi \cdot (\phi_{in}/2)^2\}$$

As shown in FIG. 12, the characteristic parameter conversion section 21 calculates the characteristic impedance $Z_c$ by performing Mathematical Expression (a1) above with respect to the sound speed $c_{air}$, density $\rho_{air}$ and diameter $\phi$in. Note that $\phi_{in}$ represents an inner diameter [m] of the mouthpiece $M_P$ at the base of the reed $M_R$ (i.e., portion of the reed $M_R$ fixed to the mouthpiece $M_P$). For example, the inner diameter $\phi$1 of the first unit portion U[1] of the tubular body model is used as the diameter $\phi$in.

Further, a distribution of spring constant $k_{lip}(x)$ [N/m$^2$] of the lip $M_L$ can be expressed by the following Mathematical Expression (a2):

$$k_{lip}(x) = [E_{lip} \cdot b_{lip}(x) \cdot l_{lip}(x) / d_{lip}(x) / l_{lip}(x)] \quad (a2)$$
$$= E_{lip} \cdot b_{lip}(x) \cdot l_{lip}(x) / d_{lip}(x)$$

As shown in FIG. 12, the characteristic parameter conversion section 21 calculates a distribution of spring constant $k_{lip}(x)$ [N/m$^2$] of the lip $M_L$ with respect to the physical property values and dimensions ($E_{lip}$, $b_{lip}(x)$ and $d_{lip}(x)$) of the lip $M_L$. In Mathematical Expression (a2) above, the horizontal width $b_{lip}(x)$ and thickness $d_{lip}(x)$ at the position x in the X direction can be determined from the tone pitch $f_n$, as will be described later.

Distribution of inner resistance $\mu_{lip}(x)$ of the lip $M_L$ can be expressed by the following Mathematical Expression (a3), in which $m_{lip_sample}$ represents a mass [kg] of the lip sample, $l_{lip_sample}$ represents a length, in the X direction, of the lip sample, and $k_{lip_sample}$ represents a distribution of spring constant [N/m] of the lip sample.

$$\mu_{lip}(x) = \tan\delta_{lip}\sqrt{\frac{m_{lip_sample}}{l_{lip_sample}} \cdot \frac{k_{lip_sample}}{l_{lip_sample}}} \quad (a3)$$
$$= \tan\delta_{lip}\sqrt{\left(\frac{\rho_{lip} \cdot b_{lip_sample} \cdot l_{lip_sample} \cdot d_{lip_sample}}{l_{lip_sample}}\right) \cdot \left(E_{lip}\frac{b_{lip_sample} \cdot l_{lip_sample}}{d_{lip_sample}} \Big/ l_{lip_sample}\right)}$$
$$= \tan\delta_{lip} \cdot b_{lip_sample} \cdot \sqrt{\rho_{lip} \cdot E_{lip}}$$

As shown in FIG. 12, the characteristic parameter conversion section 21 calculates the distribution of inner resistance $\mu_{lip}(x)$ of the lip $M_L$ by performing arithmetic operations of Mathematical Expression (a3) with respect to the physical property values ($\rho_{lip}$, $E_{lip}$ and $_{tan\ \delta\ lip}$) of the lip $M_L$ and dimensions ($b_{lip_sample}$) of the lip $M_L$. Note that, because the distribution of inner resistance $\mu_{lip}(x)$ is represented by the calculated value of Mathematical Expression (a3) for the lip sample of a simple parallelepiped shape, the distribution of inner resistance $\mu_{lip}(x)$ takes a fixed value that does not depend on the position x.

Distribution of inner resistance $\mu_{reed}(x)$ of the reed $M_R$, on the other hand, can be expressed by the following Mathematical Expression (a4), in which $m_{reed_sample}$ represents a mass [kg] of the reed sample, $I_{reed_sample}$ represents a second moment of area of the reed sample [m$^4$], and $k_{reed_sample}$ represents a distribution of spring constant [N/m] of the reed sample.

$$\mu_{reed}(x) = \tan\delta_{reed}\sqrt{\frac{m_{reed_sample}}{l_{reed_sample}} \cdot \frac{k_{reed_sample}}{l_{reed_sample}}} \quad (a4)$$
$$= \tan\delta_{reed}\sqrt{\left(\frac{\rho_{reed} \cdot b_{reed_sample} \cdot l_{reed_sample} \cdot d_{reed_sample}}{l_{reed_sample}}\right) \cdot \left(\frac{3 \cdot E_{reed} \cdot I_{reed_sample}}{l^3_{reed_sample}} \Big/ l_{reed_sample}\right)}$$
$$= \tan\delta_{reed}\sqrt{(\rho_{reed} \cdot b_{reed_sample} \cdot d_{reed_sample}) \cdot \left(\frac{3 \cdot E_{reed} \cdot \frac{1}{12} \cdot b_{reed_sample} \cdot d^3_{reed_sample}}{l^4_{reed_sample}}\right)}$$
$$= \tan\delta_{reed}\sqrt{\frac{1}{4} \cdot \frac{\rho_{reed} \cdot E_{reed} \cdot b^2_{reed_sample} \cdot d^4_{reed_sample}}{l^4_{reed_sample}}}$$
$$= \tan\delta_{reed}\frac{b_{reed_sample} \cdot d^2_{reed_sample}}{2 \cdot l^2_{reed_sample}}\sqrt{\rho_{reed} \cdot E_{reed}}$$

As shown in FIG. 12, the characteristic parameter conversion section 21 calculates the distribution of inner resistance $\mu_{reed}(x)$ of the reed $M_R$ by performing arithmetic operations of Mathematical Expression (a4) with respect to the physical property values ($\rho_{reed}$, $E_{reed}$ and $_{tan\ \delta\ lip}$) of the reed $M_R$ and dimensions ($b_{reed_sample}$, $d_{reed_sample}$ and $l_{reed_sample}$) of the reed sample. Note that, because the distribution of inner resistance $\mu_{reed}(x)$ is represented by the calculated value of Mathematical Expression (a4) for the reed sample of a simple parallelepiped shape, the distribution of inner resistance $\mu_{reed}(x)$ takes a fixed value that does not depend on the position x.

Further, as shown in FIG. 12, the characteristic parameter conversion section 21 determines a plurality of parameters ($b_{lip}(x)$, $d_{lip}(x)$, $x_{teeth}$1, $x_{teeth}$2, $x_{lip}$1, $x_{lip}$2 and $F_{lip}(x)$) pertaining to an embouchure (i.e., state of the lip $M_L$ during a performance), a coefficient for adjusting the breath pressure $P_0$ and a plurality of parameters ($r_{H1}$-$r_{Hk}$, $r_B$, $M_{H1}$-$M_{Hk}$ and $M_B$) pertaining to fingering of the wind instrument on the basis of the tone pitch $f_n$ through a key scale process ("KSC" in FIG. 12). The key scale process is a process for determining values of various parameters, corresponding to an actually designated tone pitch $f_n$, from a table where various numerical values the tone pitch $f_n$ can take and values of the parameters are associated with each other.

The plurality of parameters pertaining to an embouchure include a horizontal width (i.e., dimension in the Z direction) $b_{lip}(x)$ of the lip $M_L$, a thickness (i.e., dimension in the Y direction) $d_{lip}(x)$ [m] of the lip $M_L$ when no external force acts on the lip $M_L$, force $F_{lip}(x)$ [N] with which the human player's teeth $M_T$ press the lip $M_L$, and parameters ($x_{lip}$1, $x_{lip}$2, $x_{teeth}$1 and $x_{teeth}$2) pertaining to positions of the human player's lip $M_L$ and teeth $M_T$ relative to the reed $M_R$.

Further, the characteristic parameter conversion section 21 determines a horizontal width $b_{lip}(x)$ and thickness $d_{lip}(x)$ of the lip $M_L$ corresponding to the tone pitch $f_n$ through the key scale process and calculates a distribution of mass $m_{lip}(x)$ [kg/m] by multiplying a product between the width $b_{lip}(x)$ and the thickness $d_{lip}(x)$ by the density $\rho_{lip}$ of the lip $M_L$. The horizontal width $b_{lip}(x)$ and thickness $d_{lip}(x)$ are also applied to the aforementioned calculation of the distribution of spring constant $k_{lip}(x)$.

In order to discretize the individual positions x in the X direction as shown in FIG. 5, the characteristic parameter conversion section 21 arithmetically determines, as discretized positions ($n_{lip}$1, $n_{lip}$2), numerical values obtained by dividing the positions ($x_{lip}$1, $x_{lip}$2) by a distance Δx, and arithmetically determines, as discretized positions ($n_{teeth}$1, $n_{teeth}$2), numerical values obtained by dividing the positions ($x_{teeth}$1, $x_{teeth}$2) by the distance Δx. Further, the characteristic parameter conversion section 21 determines, as discretized positions ($n_{lip}$1, $n_{lip}$2), numerical values obtained by dividing the positions ($x_{lip}$1, $x_{lip}$2) by a distance Δx, and determines, as discretized positions ($n_{teeth}$1, $n_{teeth}$2), numerical values obtained by dividing the positions ($x_{teeth}$1, $x_{teeth}$2) by the distance Δx. Further, the characteristic parameter conversion section 21 determines, as a length $l_{teeth}$ in the X direction of the teeth $M_T$, a difference between the positions $x_{teeth}$1 and $x_{teeth}$2, and determines, as a length $l_{lip}$ in the X direction of the lip $M_L$, a difference between the positions $x_{lip}$1 and $x_{lip}$2. Then, the characteristic parameter conversion section 21 determines pressing force $f_{lip}(x)$ [N/m] acting from the teeth $M_T$ approximately on a unit length $f_{lip}(x)$ [N/m] ($f_{lip}(x)=F_{lip}(x)/l_{teeth}$).

Further, the characteristic parameter conversion section 21 determines a pressure P within the mouth cavity of the human player by determining a coefficient $p_{mul}$, corresponding to the tone pitch $f_n$, through the key scale process and multiplying the breath pressure $P_0$ by the coefficient $p_{mul}$. The coefficient $p_{mul}$ is a coefficient that varies in accordance with the tone pitch $f_n$. In the case of actual wind instruments, there is a tendency that a breath pressure range of a human player for sounding the wind instrument differs depending on the tone pitch; for example, the breath pressure range for a performance of high-pitch tones is greater than that that for a performance of lower-pitch tones. Because the coefficient $p_{mul}$ to be multiplied to the breath pressure $P_0$ is a variable value depending on the tone pitch $f_n$, the instant embodiment can faithfully simulate the aforementioned characteristics of the wind instrument even where the breath pressure $P_0$ is selected independently of the tone pitch $f_n$.

Further, the characteristic parameter conversion section 21 determines, through the key scale process, coefficients $r_{H1}$-$r_{Hk}$ to be used in the tone hole portions $T_H$[1]-$T_H$[k] of the tubular body simulating section 33 and in the bell section $B_L$, and coefficients $M_{H1}$-$M_{Hk}$ and coefficient $M_B$ to be used in the transmission simulating section 35. For example, the coefficient $M_{Hi}$ is set at zero when the first tone hole is closed during a performance of the tone pitch $f_n$, but set at a predetermined value greater than zero, such as one. Similarly, the coefficient $r_{Hi}$ is set at a different value depending on whether the i-th tone hole is closed or opened.

Figure 13:
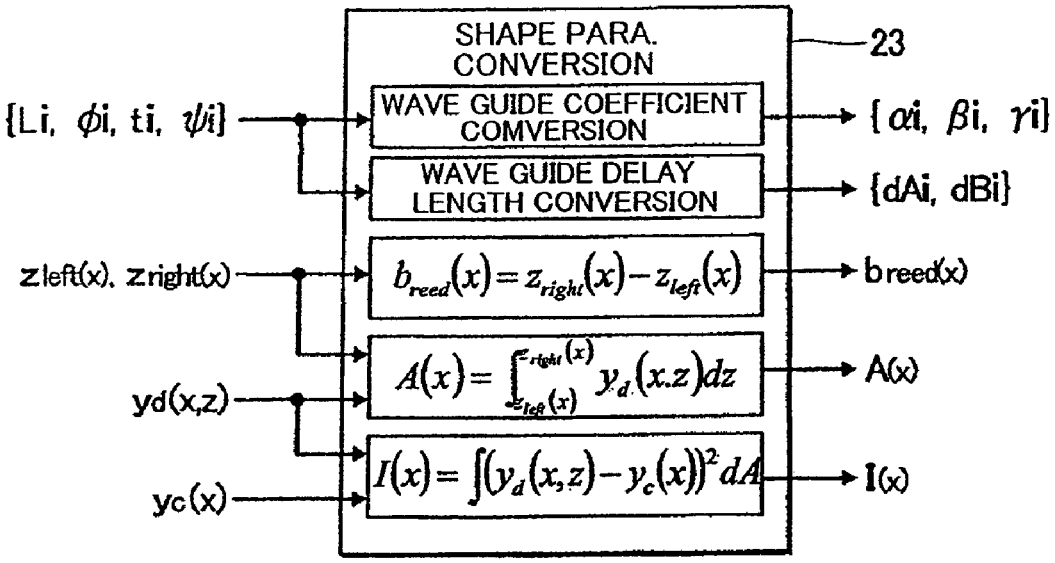
FIG. 13 is a block diagram of a shape characteristic parameter conversion section.

FIG. 13 is a block diagram showing specific functions of the shape characteristic parameter conversion section 23. As shown in FIG. 13, the shape characteristic parameter conversion section 23 is supplied with various parameters pertaining to the shapes and dimensions of the reed $M_R$ and tubular body portion. Such parameters supplied to the shape characteristic parameter conversion section 23 include parameters (Li, ϕi, ti, ψi) of the shape of each unit portion U[i] constituting the tubular portion, thickness $y_d(x, z)$ of the reed $M_R$, positions ($z_{left}(x)$, $z_{right}(x)$) of left and right end portions, in the Z direction, and position $y_c(x)$, in the Y direction, of an axis line functioning as a basis of the second moment of area I(x).

For the shape of the i-th unit portion U[i], the length Li and inner diameter ϕi of the unit portion U[i] and the depth ti and inner diameter i of the tone hole are designated, as shown in FIG. 6. First, the shape characteristic parameter conversion section 23 determines coefficients pertaining to the connecting section J[i] (i.e., coefficients α1 and β1 for the two-port type connecting section, but coefficients α1, β1 and γ1 for the three-port type connecting section) from the aforementioned coefficients. Second, the shape characteristic parameter conversion section 23 determines a delay amount $d_A$[i] of the delay element $D_A$[i] and delay amount $d_B$[i] of the delay element $D_B$[i] on the basis of the length Li of the unit portion U[i]. In addition to the aforementioned parameters, the shape characteristic parameter conversion section 23 may variably set a cut-off frequency $f_{CB}$ of the bell section $B_L$ and a cut-off frequency $f_{CTH}$ and delay amount ($d_{E1}$, $d_{E2}$) of the tone hole portion $T_H$[i].

Third, the shape characteristic parameter conversion section 23 calculates a horizontal width $B_{reed}(x)$ of the reed $M_R$ by substituting the positions ($z_{left}(x)$, $z_{right}(x)$) of the left and right end portions of the reed $M_R$ into the following equation (b1):

$$B_{reed}(x)=z_{right}(x)-z_{left}(x) \tag{b1}$$

Fourth, the shape characteristic parameter conversion section 23 calculates a sectional area A(x) of the reed $M_R$ at the position x by integrating the thickness $y_d(x, z)$ over a region from the left end position $z_{left}(x)$ to the right end position $z_{right}(x)$ of the reed $M_R$, as represented by the following equation (b2):

$$A(x) = \int_{z_{left}(x)}^{z_{right}(x)} y_d(x, z)\,dz \tag{b2}$$

Fifth, the shape characteristic parameter conversion section 23 calculates a second moment of area I(x) pertaining to the axial line of the position $y_c(x)$ by the following Equation (b3):

$$I(x)=\int(y_d(x,z)-y_c(x))^2 dA \tag{b3}$$

In the instant embodiment, as set forth above, the displacement y(x, t) of the reed $M_R$ is calculated on the basis of Motion Equation B that expresses coupled vibration of the reed $M_R$ and lip $M_L$. Thus, the instant embodiment can faithfully simulate the behavior of the reed $M_R$ as compared to the technique of Non-patent Literature 1 which models a reed as a rigid air valve freely movable in its entirety and the technique of Non-patent Literature 2 which models a reed using a vibrating member in the form of an elongate plate. Further, because, each time the pressing force $f_{lip}(x)$ acting from the lip $M_L$ on the reed $M_R$ is changed, the displacement $y_b(x)$ of the lip $M_L$ in Motion Equation B is updated with a result calculated from the changed pressing force $f_{lip}(x)$ on the basis of Motion Equation A1 and Motion Equation B, the instant embodiment can faithfully simulate a rendition style which changes the pressing force $f_{lip}(x)$. Because the displacement y(x, t) of the reed $M_R$ in Motion Equation B is maintained even when the pressing force $f_{lip}(x)$ is changed, the instant embodiment can effectively minimize an uncomfortable feeling of a tone arising from a discontinuous change of the displacement y(x, t).

Second Embodiment

Next, a description will be given about a second embodiment of the present invention. Whereas the first embodiment has been described above in relation to the case where the spring constant $k_{lip}(x)$ does not depend on the pressing force $f_{lip}(x)$ from the teeth $M_T$, the second embodiment uses a spring constant $k_{lip}(x)$ $(x, f_{lip}(x))$ that depends on the pressing force $f_{lip}(x)$. In the following description of the second and other embodiments, similar elements to those in the first embodiment are indicated by the same reference numerals and characters as used for the first embodiment and description of these similar elements are omitted here as necessary to avoid unnecessary duplication.

Figure 14:
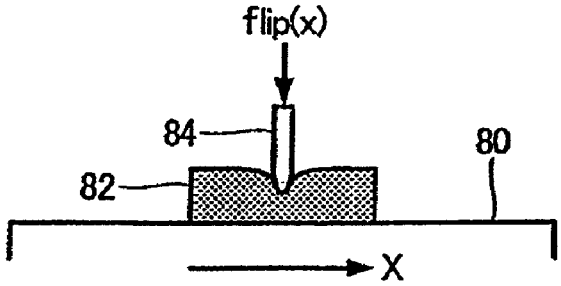
FIG. 14 is a diagram explanatory of how a spring constant is measured.

Relationship between the spring constant $k_{lip}(x)$ $(x, f_{lip}(x))$ of the lip $M_L$ and the pressing force $f_{lip}(x)$ is determined through actual measurement. FIG. 14 is a diagram explanatory of how the spring constant $k_{lip}(x)$ $(x, f_{lip}(x))$ is measured. As shown in FIG. 14, an outer surface of a test piece 82 placed on a working table 80 is pressed by a pressing member 84. The test piece 82 is an elastic member having substantially the same elastic characteristic as the lip $M_L$. The pressing member 84 presses only part of the surface of the test piece 82 in generally the same manner as where the teeth $M_T$ of the human player presses the lip $M_L$. Operation for measuring an amount of deformation of the test piece 82 to determine a spring constant $k_{lip}(x)$ $(x, f_{lip}(x))$ is repeated while varying the intensity of the pressing force $f_{lip}(x)$ and changing the position x to be pressed by the pressing member 84. Through the aforementioned test, the relationship between the spring constant $k_{lip}(x)$ $(x, f_{lip}(x))$ of the lip $M_L$ and the pressing force $f_{lip}(x)$ is measured per position x.

Figure 15:
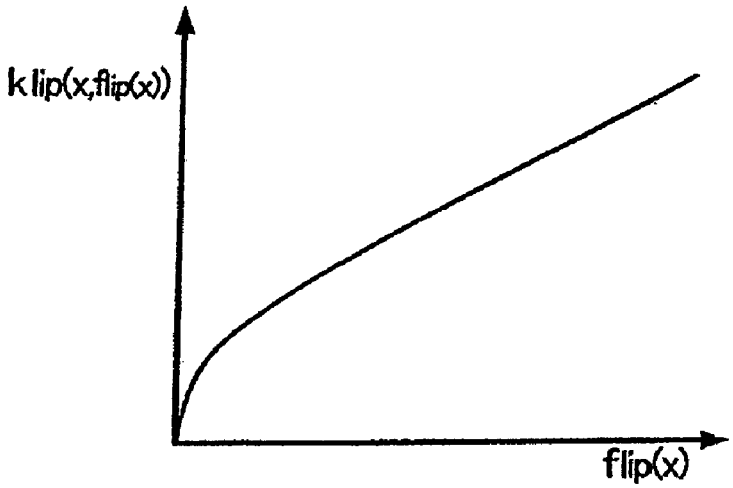
FIG. 15 is a graph showing relationship between pressing force acting on a lip (test piece) and a spring constant.

FIG. 15 is a graph showing relationship between the pressing force $f_{lip}(x)$ and the spring constant $k_{lip}(x)$ $(x, f_{lip}(x))$ observed when particular positions x of the test piece 82 were pressed by the pressing member 84. As shown in FIG. 15, the spring constant $k_{lip}(x)$ $(x, f_{lip}(x))$ of the test piece 82 varies according to the intensity of the pressing force $f_{lip}(x)$. Namely, the spring constant $k_{lip}(x)$ $(x, f_{lip}(x))$ increases as the intensity of the pressing force $f_{lip}(x)$ increases.

Upon completion of the aforementioned measurement, a function, such as a spline function, approximating the relationship between the pressing force $f_{lip}(x)$ and the spring constant $k_{lip}(x)$ $(x, f_{lip}(x))$ is determined for each of a plurality of positions x. Further, a function (hereinafter referred to as "resiliency function") defining relationship among the position x, on which the pressing force $f_{lip}(x)$ acts, the intensity of the pressing force $f_{lip}(x)$ and the spring constant $k_{lip}(x)$ $(x, f_{lip}(x))$ is determined for each of a plurality of types of lips $M_L$ by the aforementioned operations being repeated for a plurality of test pieces 82 differing from one another in physical property and dimension. Each of the thus-determined resiliency functions is stored into the storage device 42 of the tone synthesis apparatus 100.

The user selects any one of the plurality of types of lips $M_L$ by operating the input device 44. The characteristic parameter conversion section 21 of FIG. 1 acquires, from the storage device 42, the resiliency function corresponding to the user-selected lip $M_L$ and then calculates a spring constant $k_{lip}(x)$ $(x, f_{lip}(x))$ by substituting the pressing force $f_{lip}(x)$ into the resiliency function. The spring constant $k_{lip}(x)$ $(x, f_{lip}(x))$ thus calculated by the characteristic parameter conversion section 21 is used in arithmetic operations by the reed simulating section 31 (more specifically, by the first and second arithmetic operation sections 311 and 312).

In the instant embodiment, as set forth above, the spring constant $k_{lip}(x)$ $(x, f_{lip}(x))$ varies in accordance with not only the position x on which the pressing force $f_{lip}(x)$ acts, but also the intensity of the pressing force $f_{lip}(x)$. Namely, the instant embodiment can faithfully reproduce behavior of an actual wind instrument in which the generated tone varies in accordance with the intensity of the pressing force $f_{lip}(x)$ acting from the teeth on the lip during a performance and position (x) of the teeth relative to the lip. In this way, the instant embodiment can faithfully synthesize a variety of tones corresponding to various rendition styles.

Whereas, in the above-described measurement, the pressing force $f_{lip}(x)$ is caused to act on part of the test piece 82, there may be employed an alternative method in which the pressing force $f_{lip}(x)$ is caused to act on the entire upper surface of the test piece 82 so as to measure a spring constant $k_{lip}(x)$ $(x, f_{lip}(x))$. In the case where such an alternative method is employed, a spring constant $k_{lip}(x)$ $(x, f_{lip}(x))$ that varies in accordance with the pressing force $f_{lip}(x)$ but does not depend on the position x is defined by the elastic function. In this way, it is possible to reproduce behavior in which the generated tone varies in accordance with the pressing force acting from the teeth to the lip.

Third Embodiment

In the above-described first embodiment, the internal resistance $\mu_{lip}(x)$ of the lip $M_L$ and the internal resistance $\mu_{reed}(x)$ of the reed $M_R$ take fixed values that do not depend on the position x. However, in a third embodiment to be described below, the internal resistance $\mu_{lip}(x)$ of the lip $M_L$ and the internal resistance $\mu_{reed}(x)$ of the reed $M_R$ are varied in accordance with the position x.

If the horizontal width $b_{lip_sample}$ of the lip sample in Mathematical Expression (a3) above is substituted by a horizontal width $b_{lip}(x)$ corresponding to the position x, the following Mathematical Expression (a3-1) is derived:

$$\begin{aligned}\mu_{lip}(x) &= \tan\delta_{lip}\sqrt{m_{lip}(x)\cdot k_{lip}(x)} \\ &= \tan\delta_{lip}\sqrt{\rho_{lip}\cdot b_{lip}(x)\cdot d_{lip}(x)\cdot E_{lip}\frac{b_{lip}(x)}{d_{lip}(x)}} \\ &= \tan\delta_{lip}\cdot b_{lip}(x)\cdot\sqrt{\rho_{lip}\cdot E_{lip}}\end{aligned} \tag{a3-1}$$

Similarly, for the internal resistance $\mu_{reed}(x)$ of the reed $M_R$, there can be derived the following Equation (a4-1) where the sectional area A(x) of the reed $M_R$ that varies in accordance with the position x and the spring constant $k_{reed}(x)$ are variables:

$$\begin{aligned}\mu_{reed}(x) &= \tan\delta_{reed}\sqrt{m_{reed}(x)\cdot k_{reed}(x)} \\ &= \tan\delta_{reed}\sqrt{\rho_{reed}\cdot A(x)\cdot k_{reed}(x)}\end{aligned} \tag{a4-1}$$

Figure 16:
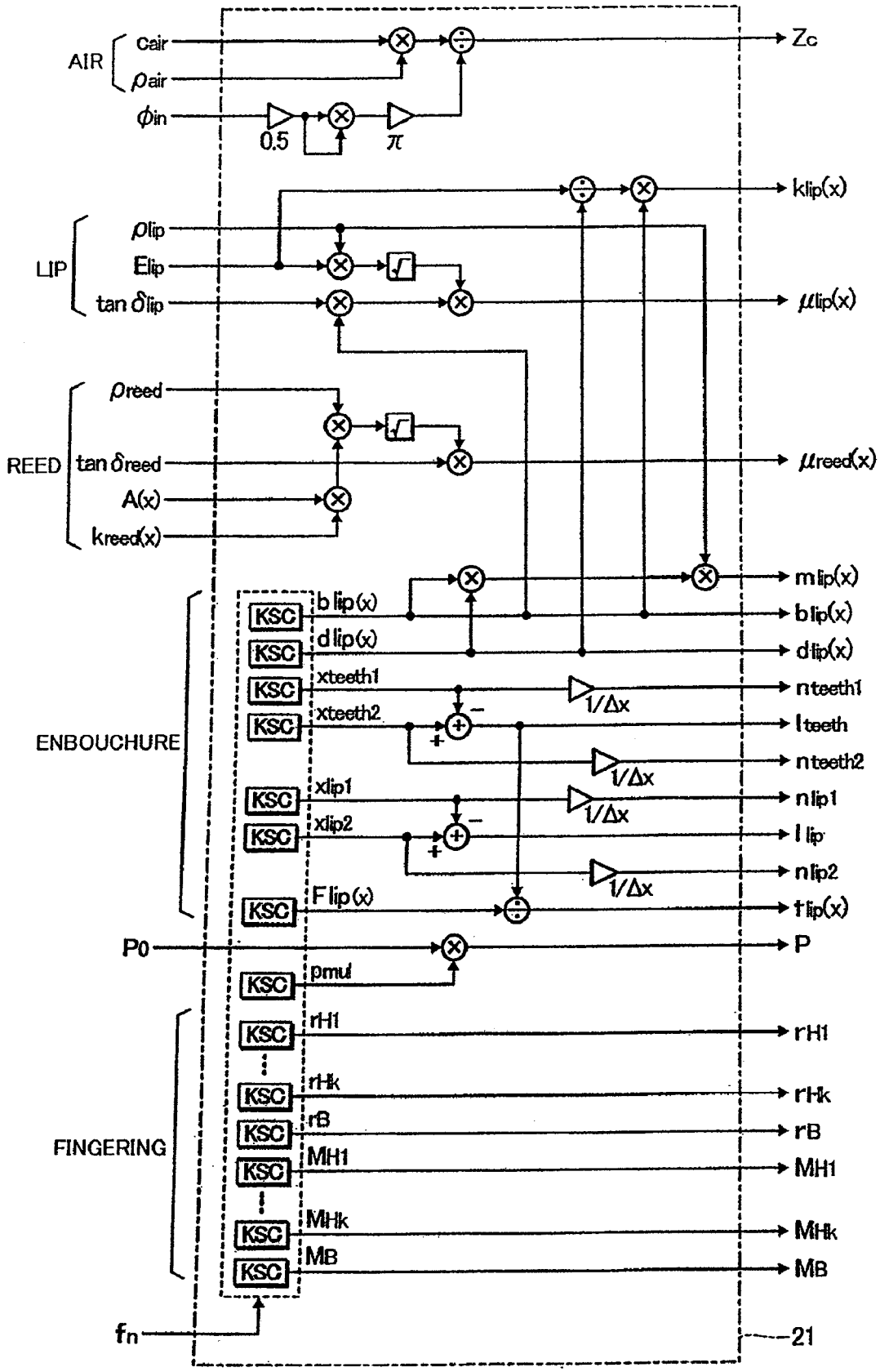
FIG. 16 is a block diagram of a characteristic parameter conversion section employed in a third embodiment of the present invention.

FIG. 16 is a block diagram showing the characteristic parameter conversion section 21 employed in the third embodiment. As shown, the characteristic parameter conversion section 21 calculates the internal resistance $\mu_{lip}(x)$ corresponding to the position x by performing the arithmetic operation of Equation (a3-1) with respect to the physical property values and dimension ($_{tan\ \delta\ lip}$, $b_{lip}(x)$, $\rho_{lip}$ and $E_{lip}$ (x)) of the lip $M_L$. The horizontal width $b_{lip}(x)$ is calculated from the tone pitch $f_n$ through a key process as in the above-described first embodiment.

Further, the characteristic parameter conversion section 21 calculates the internal resistance $\mu_{reed}(x)$ corresponding to the position x by performing the arithmetic operation of Equation (a4-1) with respect to the physical property values ($_{tan\ \delta\ reed}$, $\rho_{reed}$, A(x) and $k_{reed}(x)$). The sectional area A(x) calculated by the shape characteristic parameter conversion section 23 performing the arithmetic operation of Equation (b2) is used in the arithmetic operation of Equation (a4-1). Numerical value stored in the storage device 42 or designated via the input device 44, for example, is used as the spring constant $k_{reed}(x)$ [N/m] of the reed $M_R$ in Equation (a4-1).

The internal resistance $\mu_{lip}(x)$ and internal resistance $\mu_{reed}(x)$ calculated in the aforementioned arithmetic operation sequence are used in the arithmetic operation of Motion Equation B by the second arithmetic operation section 312. With the instant embodiment, where the internal resistance $\mu_{lip}(x)$ of the lip $M_L$ and internal resistance $\mu_{reed}(x)$ of the reed $M_R$ change in accordance with the position x, it is possible to faithfully reproduce tones of an actual wind instrument as compared to the construction (e.g., construction of the first embodiment) where the internal resistance $\mu_{lip}(x)$ and internal resistance $\mu_{reed}(x)$ are set at fixed values.

Fourth Embodiment

In a case where deformation of the lip $M_L$ and reed $M_R$ is relatively small, i.e. where the lip $M_L$ and reed $M_R$ deform within an elasticity limit), even the third embodiment where the internal resistance $\mu_{lip}(x)$ and internal resistance $\mu_{reed}(x)$ depend only on the position x can faithfully reproduce tones of an actual wind instrument. However, in a case where deformation of the lip $M_L$ and reed $M_R$ is great, i.e. where deformation of the lip $M_L$ and reed $M_R$ is outside the elasticity limit), the internal resistance $f_{lip}(x))$ of the lip $M_L$ depends not only on the position x but also on the pressing force $f_{lip}(x)$, and the internal resistance $\mu_{reed}(x, f_{reed}(x))$ of the reed $M_R$ depends not only on the position x but also on the pressing force $f_{reed}(x)$ on the reed $M_R$.

Figure 17:
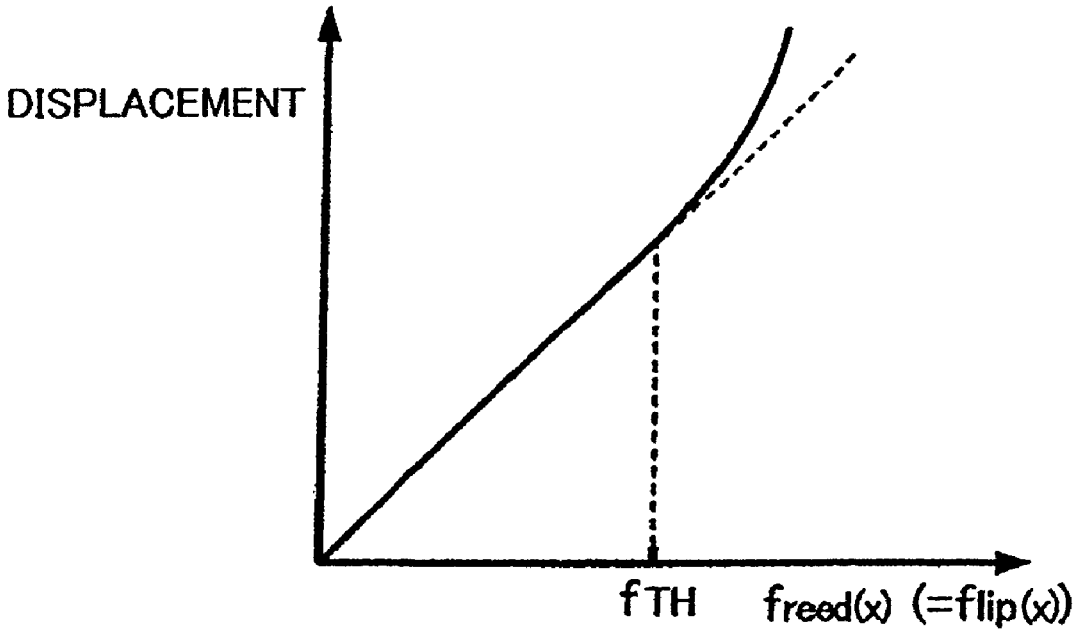
FIG. 17 is graph showing relationship between pressing force acting on the reed and a displacement amount of the reed.

FIG. 17 is graph showing relationship between the pressing force $f_{reed}(x)$ acting on the reed $M_R$ and the displacement (amount) of the reed $M_R$. As shown, once the pressing force $f_{reed}(x)$ exceeds a predetermined value $f_{TH}$, i.e. once the pressing force $f_{reed}(x)$ reaches the elasticity limit, the displacement of the reed $M_R$ changes non-linearly. Namely, as the intensity of the pressing force $f_{reed}(x)$ increases, the spring constant $k_{lip}(x)$ $(x, f_{lip}(x))$ decreases (i.e., the reed $M_R$ becomes easier to deform). Because the pressing force $f_{reed}(x)$ acting from the lip $M_L$ on the reed $M_R$ is equal to the pressing force $f_{lip}(x)$ acting from the reed $M_R$ on the lip $M_L$, the pressing force $f_{reed}(x)$ is written as the pressing force $f_{lip}(x)$, for convenience sake, in the following description.

The internal resistance $\mu_{lip}(x, f_{lip}(x))$ of the lip $M_L$ is defined by Equation (a3-2) below. Because the spring constant $k_{lip}(x)$ $(x, f_{lip}(x))$ in Equation (a3-2) is a function of the pressing force $f_{lip}(x)$, the internal resistance $f_{lip}(x))$ changes in accordance with the position x and pressing force $f_{lip}(x)$. Similarly, the internal resistance $\mu_{reed}(x, f_{lip}(x))$ of the reed $M_R$ changes in accordance with the position x and pressing force $f_{lip}(x)$ (spring constant $k_{reed}(x, f_{lip}(x))$, as defined by Equation (a4-2) below.

$$\mu_{lip}(x, f_{lip}(x)) = \tan\delta_{lip}\sqrt{m_{lip}(x)\cdot k_{lip}(x, f_{lip}(x))} \quad \text{(a3-2)}$$

$$u_{reed}(x, f_{lip}(x)) = \tan\delta_{reed}\sqrt{m_{reed}(x)\cdot k_{reed}(x, f_{lip}(x))} = \tan\delta_{reed}\sqrt{\rho_{reed}\cdot A(x)\cdot k_{reed}(x, f_{lip}(x))} \quad \text{(a4-2)}$$

Figure 18:
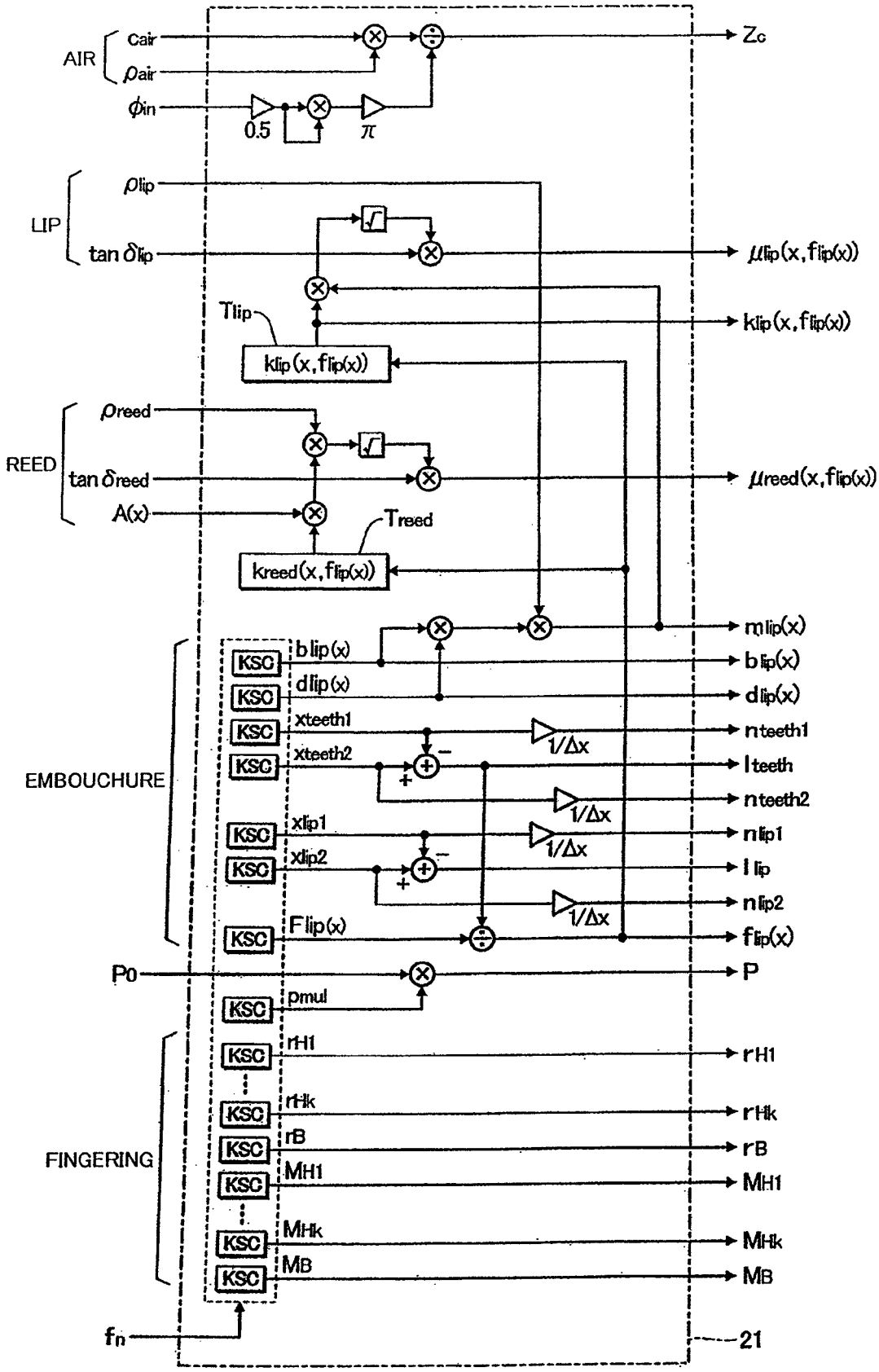
FIG. 18 is a block diagram of a characteristic parameter conversion section employed in a fourth embodiment of the present invention.

FIG. 18 is a block diagram showing the characteristic parameter conversion section 21 employed in the fourth embodiment. As shown, the characteristic parameter conversion section 21 has two types of tables ($T_{lip}$, $T_{reed}$). The table $T_{lip}$ correlates values of the pressing force $f_{lip}(x)$ and the spring constant $k_{lip}(x)$ $(x, f_{lip}(x))$ of the lip $M_L$ to each other, and the table $T_{reed}$ correlates values of the pressing force $f_{lip}(x)$ and the spring constant $k_{reed}(x)$ $(x, f_{lip}(x))$ of the reed $M_R$ to each other. Contents of the table $T_{lip}$ and table $T_{reed}$ are set in accordance with results of experiments where pressing force was applied to an actual lip and reed. The characteristic parameter conversion section 21 searches through the table $T_{lip}$ for a spring constant $k_{lip}(x)$ $(x, f_{lip}(x))$ corresponding to pressing force $f_{lip}(x)$ per unit length calculated by dividing pressing force $F_{lip}(x)$, calculated through a key scale process, by a length $l_{teeth}$ of the teeth $M_T$, and then searches through the table $T_{reed}$ for a spring constant $k_{reed}(x)$ $(x, f_{lip}(x))$ corresponding to the pressing force $f_{lip}(x)$.

Then, the characteristic parameter conversion section 21 calculates internal resistance $\mu_{lip}(x, f_{lip}(x))$ corresponding to the position x and pressing force $f_{lip}(x)$ by performing the arithmetic operation of Equation (a3-2) with respect to the spring constant $k_{lip}(x)$ $(x, f_{lip}(x))$ searched out from the table $T_{lip}$ and physical property values ($m_{lip}$ and $_{tan\ \delta\ lip}$) of the lip $M_L$. As in the above-described first embodiment, the distribution of mass $m_{lip}(x)$ in Equation (a3-2) above is a result of multiplication between the horizontal width $b_{lip}(x)$ and the density $\rho_{lip}$. Further, the characteristic parameter conversion section 21 calculates internal resistance $\mu_{reed}(x, f_{lip}(x))$ corresponding to the position x and pressing force $f_{lip}(x)$ by performing the arithmetic operation of Equation (a4-2) with respect to the spring constant $k_{reed}(x)$ $(x, f_{lip}(x))$ searched out from the table $T_{reed}$ and physical property values and dimension ($_{tan\ \delta\ reed}$, $\rho_{reed}$ and $A(x)$) of the reed $M_R$.

The internal resistance $\mu_{lip}(x, f_{lip}(x))$ and internal resistance $\mu_{reed}(x)$ $(x, f_{lip}(x))$ calculated in the aforementioned arithmetic operational sequence are used in the arithmetic operation of Motion Equation B by the second arithmetic operation section 312. With the instant embodiment, where the internal resistance $\mu_{lip}(x, f_{lip}(x))$ of the lip $M_L$ and internal resistance $\mu_{reed}(x)(x, f_{lip}(x))$ of the reed $M_R$ change in accordance with the position x and intensity of the pressing force $f_{lip}(x)$, it is possible to faithfully reproduce tones of an actual wind instrument as compared to the construction (e.g., construction of the first embodiment) where the internal resistance $\mu_{lip}(x)$ and internal resistance $\mu_{reed}(x)$ are set at fixed values. Whereas the foregoing description has been made assuming that deformation of the lip $M_L$ and reed $M_R$ is outside the elasticity limit, the construction of FIG. 18 is also applicable to the case where deformation of the lip $M_L$ and reed $M_R$ is only within the elasticity limit.

<Modification>

The above-described embodiments may be modified variously as set forth below by way of example.

(1) Modification 1:

Whereas the embodiments have been described above in relation to the case where the characteristic parameter conversion section 21 and shape characteristic parameter conversion section 23 convert user-input parameters into parameters necessary for tone synthesis, there may be employed an alternative construction where various parameters to be used in arithmetic operations by the synthesis section 14 are input directly by the user. For example, although FIG. 12 illustratively shows the construction where parameters pertaining to the embouchure and fingering are calculated through the key scale process, there may be employed an alternative construction where such parameters pertaining to the embouchure and fingering are input or designated directly to the arithmetic operation processing device 10 by the user via the input device 44.

(2) Modification 2:

Whereas the embodiments have been described above in relation to the case where the product between the Young's modulus and the second moment of area I(x) of the reed $M_R$ is determined as bending rigidity $S_{till}(x)$ of the reed $M_R$, there may be employed an alternative construction where bending rigidity $S_{till}(x)$ of the reed $M_R$ is determined from results of actual measurements. In one example, bending rigidity $S_{till}(x)$ is determined from displacement of a test piece, simulating the reed $M_R$, measured with pressing force applied to various positions x of the test piece, and then a function (hereinafter "rigidity function") approximating relationship between the position x and the bending rigidity $S_{till}(x)$ is created. Such rigidity functions of a plurality of types of reeds $M_R$, differing in physical property value and dimension, are sequentially created in the aforementioned manner and stored into the storage device 42. The reed simulating section 31 (more specifically, the first and second arithmetic operation sections 311 and 312) of the arithmetic operation processing device 10 acquires, from the storage device 42, rigidity function corresponding to any one of the reeds $M_R$ (e.g., reed $M_R$ selected by the user) and uses the acquired rigidity function in subsequent arithmetic operations. Such arrangements too can achieve substantially the same advantageous benefits as the first and second embodiments.

(3) Modification 3:

Tone synthesis based on the displacement y(x, t) calculated by the second arithmetic operation section 312 may be performed in any desired manner. For example, there may be employed a construction where simulation of sound wave losses in tone holes and boundary between inside and outside of the bell is omitted.

This application is based on, and claims priority to, JP PA 2008-003383 filed on 10 Jan. 2008 and JP PA 2008-120311 filed on 2 May 2008. The disclosure of the priority applications, in its entirety, including the drawings, claims, and the specification thereof, is incorporated herein by reference.

What is claimed is:

1. An apparatus for synthesizing a tone of a wind instrument that is generated in response to vibration of a reed contacting a lip during a performance of the wind instrument, said apparatus comprising:

a first arithmetic operation section that solves a first motion equation representative of behavior of the reed in an equilibrium state with external force acting on the lip and a second motion equation representative of behavior of the lip in the equilibrium state, to thereby calculate displacement of the lip and displacement of the reed in the equilibrium state;

a second arithmetic operation section that solves a motion equation of coupled vibration of the lip and the reed with calculation results of said first arithmetic operation section used as initial values of the displacement of the lip and the displacement of the reed, to thereby calculate the displacement of the reed; and a tone synthesis section that synthesizes a tone on the basis of the displacement calculated by said second arithmetic operation section.

2. The apparatus as claimed in claim 1 wherein, each time intensity of the external force acting on the lip changes, said first arithmetic operation section calculates displacement of the lip corresponding to the changed intensity of the external force on the basis of said first motion equation and said second motion equation, and said second arithmetic operation section calculates displacement of the reed by substituting the displacement of the lip, calculated by said first arithmetic operation section, into said motion equation of coupled vibration.

3. The apparatus as claimed in claim 1 wherein said first motion equation and said second motion equation include a spring constant of the lip that changes in accordance with a position in the lip and intensity of pressing force acting on the lip.

4. The apparatus as claimed in claim 1 wherein said first motion equation includes bending rigidity that changes in accordance with a position of the reed.

5. The apparatus as claimed in claim 1 wherein said second arithmetic operation section limits the displacement of the reed to within a predetermined range.

6. The apparatus as claimed in claim 1 wherein said motion equation of coupled vibration includes at least one of internal resistance of the lip that changes in accordance with a position in the lip and internal resistance of the reed that changes in accordance with a position in the reed.

7. The apparatus as claimed in claim 1 wherein said motion equation of coupled vibration includes at least one of internal resistance of the lip that changes in accordance with a position in the lip and pressing force acting on the lip and internal resistance of the reed that changes in accordance with a position in the reed and pressing force acting on the reed.

8. A method performed by a computer for synthesizing a tone of a wind instrument that is generated in response to vibration of a reed contacting a lip during a performance of the wind instrument, said method comprising:

a first arithmetic operation step of solving a first motion equation representative of behavior of the reed in an equilibrium state with external force acting on the lip and a second motion equation representative of behavior of the lip in the equilibrium state, to thereby calculate displacement of the lip and displacement of the reed in the equilibrium state;

a second arithmetic operation step of solving a motion equation of coupled vibration of the lip and the reed with calculation results of said first arithmetic operation step used as initial values of the displacement of the lip and the displacement of the reed, to thereby calculate the displacement of the reed; and a tone synthesis step of synthesizing a tone on the basis of the displacement calculated by said second arithmetic operation step.

9. A computer-readable medium storing a program executable by a computer for synthesizing a tone of a wind instrument that is generated in response to vibration of a reed contacting a lip during a performance of the wind instrument, said method comprising:

a first arithmetic operation step of solving a first motion equation representative of behavior of the reed in an equilibrium state with external force acting on the lip and a second motion equation representative of behavior of the lip in the equilibrium state, to thereby calculate displacement of the lip and displacement of the reed in the equilibrium state;

a second arithmetic operation step of solving a motion equation of coupled vibration of the lip and the reed with calculation results of said first arithmetic operation step used as initial values of the displacement of the lip and the displacement of the reed, to thereby calculate the displacement of the reed; and a tone synthesis step of synthesizing a tone on the basis of the displacement calculated by said second arithmetic operation step.

* * * * *